US011478818B2

(12) United States Patent
Ren et al.

(10) Patent No.: US 11,478,818 B2
(45) Date of Patent: Oct. 25, 2022

(54) ELECTRIC GLUE GUN AND CONTROL METHOD FOR THE SAME

(71) Applicant: Nanjing Chervon Industry Co., Ltd., Nanjing (CN)

(72) Inventors: Yufei Ren, Nanjing (CN); Xiangqing Fu, Nanjing (CN); Wenkang Tong, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 57 days.

(21) Appl. No.: 16/837,091

(22) Filed: Apr. 1, 2020

(65) Prior Publication Data

US 2020/0316639 A1 Oct. 8, 2020

(30) Foreign Application Priority Data

Apr. 4, 2019 (CN) ..... 201910269558.2
Mar. 20, 2020 (CN) ..... 202010201582.5

(51) Int. Cl.
*B05C 17/01* (2006.01)

(52) U.S. Cl.
CPC ..... *B05C 17/0103* (2013.01)

(58) Field of Classification Search
CPC ..... B05C 17/0103
See application file for complete search history.

(56) References Cited

U.S. PATENT DOCUMENTS

2004/0045982 A1* 3/2004 Herman ..... B05C 17/00553 222/145.5
2009/0101673 A1* 4/2009 Alioto ..... B05C 17/00553 222/113
2010/0001017 A1* 1/2010 Herman ..... B05C 17/0103 222/1
2015/0014351 A1* 1/2015 Grontved ..... B05C 17/0116 222/333
2017/0189930 A1* 7/2017 Turner ..... B05C 17/0103
2019/0290406 A1* 9/2019 Griffin ..... A61C 1/0015
2021/0094063 A1* 4/2021 Welch ..... B05C 17/00593

FOREIGN PATENT DOCUMENTS

CA 2718324 A1 * 4/2011 ..... B29C 48/02
CN 102039260 A 5/2011

* cited by examiner

*Primary Examiner* — Jeremy Carroll
(74) *Attorney, Agent, or Firm* — Greenberg Traurig, LLP

(57) ABSTRACT

An electric glue gun includes a housing, a motor supported by the housing, a bracket which extends from the housing for supporting a glue cartridge, a pushing mechanism, supported by the housing and connected to the motor, comprising a drive rod wherein the pushing mechanism is driven by the motor to enable the drive rod to squeeze glue out of the glue cartridge, and a controller configured to control the motor to enable the drive rod to return by a preset distance after the motor stops driving the drive rod forward or after the drive rod reaches a limited position.

8 Claims, 16 Drawing Sheets

ELECTRIC GLUE GUN AND CONTROL METHOD FOR THE SAME

RELATED APPLICATION INFORMATION

This application claims the benefit under 35 U.S.C. § 119(a) of Chinese Patent Application No. CN 201910269558.2, filed on Apr. 4, 2019, and Chinese Patent Application No. CN 202010201582.5, filed on Mar. 20, 2020, the disclosures of which are incorporated herein by reference in their entirety.

TECHNICAL FIELD

The present disclosure relates to an electric glue gun and a control method for the electric glue gun.

BACKGROUND

An electric glue gun is a tool for automatically spraying glue or squeezing glue, and is widely used in building decoration, electronic appliances, automobile parts and other industries. Compared with a manual glue gun, the electric glue gun has a high degree of automation and is relatively labor-saving. However, the existing electric glue gun has some shortcomings. After a user releases the trigger to stop the glue spraying work a glue sheet used for holding the glue may be stuck on a top of an end of a drive rod in a glue cartridge due to being squeezed and wrinkled. In such a case a user needs to use force to pull the glue sheet out and replace the glue sheet. Also, after the glue spraying is stopped, a drive rod may overextend and exceed the limited position, which is inconvenient for unlocking the drive rod. In addition, the glue may flow out or leak out of a nozzle of the glue gun after the glue spraying work is stopped, which produces dirt around the nozzle and adds extra labor cost and time to clean the glue.

SUMMARY

To solve the shortcomings in the existing art, the object of the present disclosure is to provide an electric glue gun and a control method for an electric glue gun to facilitate disassembly of a glue sheet of a glue and unlocking of a drive rod, and prevent the glue from continuing to leak out of a nozzle after the glue spraying is stopped.

In one example, an electric glue gun includes a housing; a motor, which is supported by the housing; a bracket, which extends from the housing and is used for supporting a glue cartridge; a pushing mechanism, which is supported by the housing and connected to the motor, where the drive rod mechanism includes a drive rod, and the pushing mechanism is driven by the motor to enable the drive rod to squeeze glue out of the glue cartridge; and a controller, which is configured for controlling the motor; where the controller is configured to: after the motor stops driving the drive rod forward or after the drive rod reaches a limited position, control the motor to enable the drive rod to return by a preset distance.

In another example, an electric glue gun includes a housing; a motor, which is supported by the housing and includes an output shaft; a bracket, which extends from the housing and is used for supporting a glue cartridge; a pushing mechanism, including a drive rod, where the pushing mechanism is supported by the housing and connected to the output shaft, and the pushing mechanism is driven by the output shaft to enable the drive rod to squeeze glue out of the glue cartridge; an operation switch, at least including an operation state causing the motor to stop driving the drive rod forward; and a controller, which is connected to the motor and the operation switch, and in condition that the operation switch is in the operation state in which the motor stops driving the drive rod forward, the controller controls the motor to enable the drive rod to return by a preset distance; where in condition that the glue gun is restarted, the controller controls the electric glue gun to enter an acceleration mode to accelerate the drive rod forward; and after the drive rod overcomes the returned preset distance, the controller controls the electric glue gun to switch to a speed mode and a rotation speed which are set by a user to work.

In yet another example, a control method for an electric glue gun is provided, where the electric glue gun includes a motor and a drive rod driven by the motor. The control method includes: after the motor stops driving the drive rod forward, controlling the motor to enable the drive rod to return by a preset distance; after the glue gun is restarted, controlling the electric glue gun to enter an acceleration mode to overcome the preset distance by which the drive rod returns; and when the drive rod has overcome the returned preset distance, controlling the electric glue gun to switch to a speed mode and a rotation speed which are set by a user to work.

The present disclosure facilitates disassembly of the glue sheet of the glue and unlocking of the drive rod, and can prevent the glue from continuing to leak out of the nozzle after the glue spraying is stopped, and thus prevent generation of nozzle dirt.

DETAILED DESCRIPTION

Figure 1:
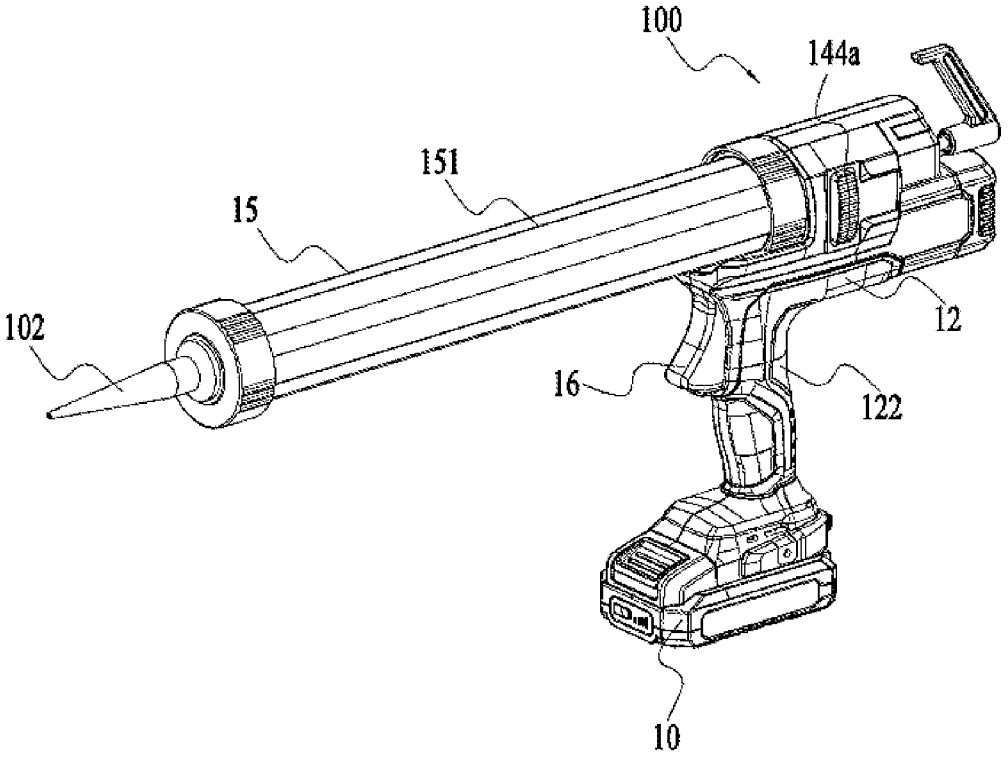
FIG. 1 is a perspective view of an electric glue gun in a state of being mounted with a glue cartridge.

Referring to FIGS. 1 to 4, an electric glue gun 100 includes a prime mover, a housing 12, and a pushing mechanism 14.

The housing 12 is formed with a first receiving cavity 121, the prime mover is disposed in the first receiving cavity 121 of the housing 12, and the housing 12 is further formed with a handle 122 for an operator to hold. In this example, the prime mover is a motor 11, and the motor includes a motor shaft 111 for driving an output shaft 145 to rotate around a central axis.

The electric glue gun 100 further includes a speed changing device 13. The speed changing device 13 is disposed in the first receiving cavity 121 of housing 12, and is located between the motor shaft 111 of the motor 11 and the output shaft 145 for changing the rotation rate outputted by the motor 11 while transmitting the rotation to the output shaft 145. The specific structure of the speed changing device 13 is already well known in the art and, as such, need not be described in detail.

Figure 2:
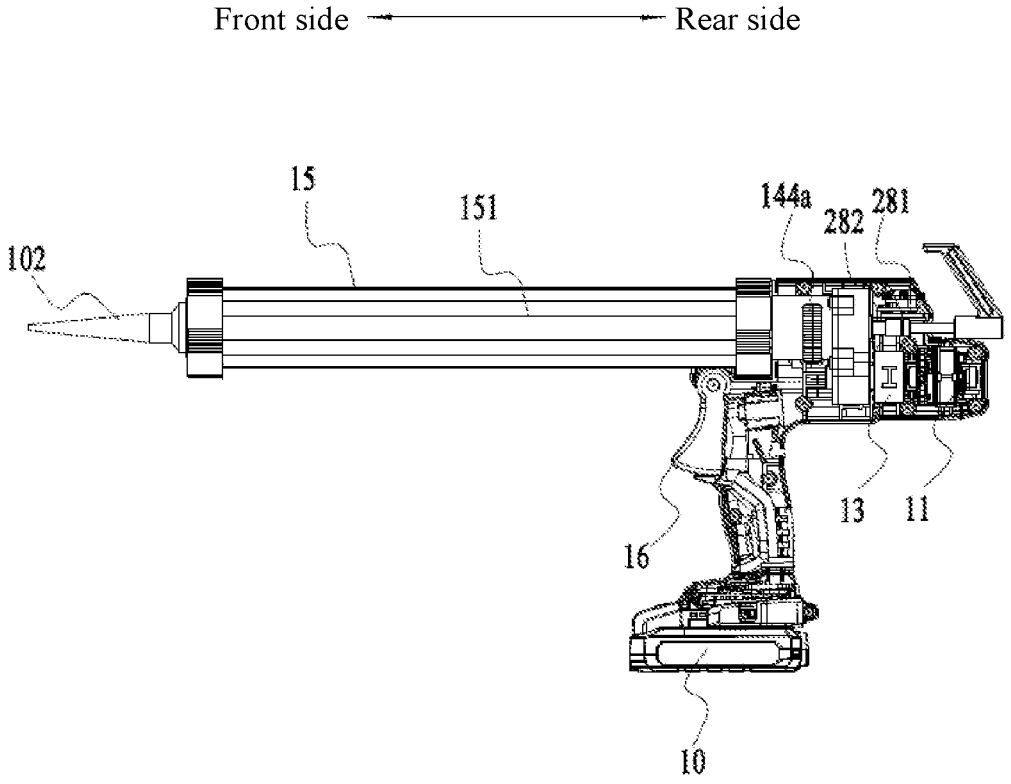
FIG. 2 is a partial plan view of the electric glue gun of FIG. 1.
Figure 3:
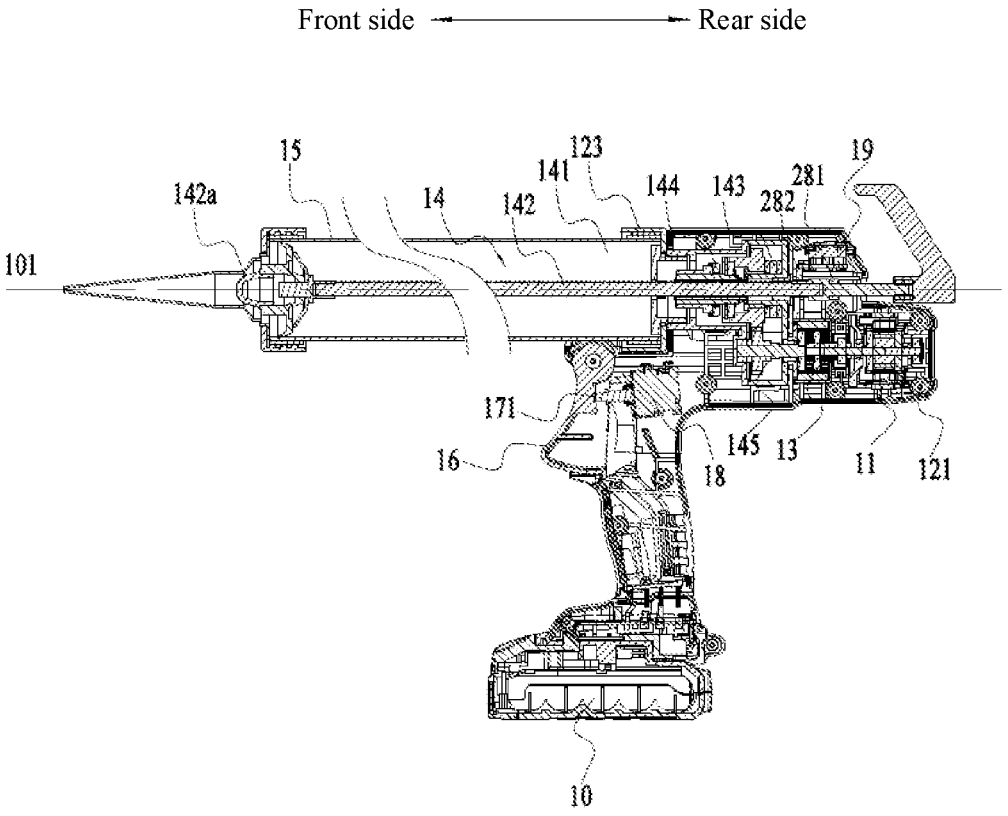
FIG. 3 is a partial sectional view of the electric glue gun of FIG. 2.

The pushing mechanism 14 includes a second receiving cavity 141, a drive rod 142, a transmission mechanism 143, and a locking mechanism 144. The transmission mechanism 143 is connected to the output shaft 145, and is used for driving the drive rod 142 to slide along a first linear direction 101, thereby squeezing out the glue. The transmission mechanism 143 is formed with or connected to a rotating member of the drive rod, the output shaft 145 drives the rotating member of the drive rod to rotate, and the drive rod 142 passes through the rotating member of the drive rod and is driven with the rotation of the rotating member of the drive rod 142. In order to clearly illustrate the technical solution of the present disclosure, a front side and a rear side shown in FIG. 2 and FIG. 3 are also defined.

The second receiving cavity 141 is used for mounting and fixing a glue cartridge 15, and the glue cartridge 15 contains the glue inside. When the drive rod 142 is moved forward, a squeeze force is generated to squeeze the glue out of the glue sheet covering the glue, so that the glue can be squeezed out of the glue cartridge 15. The housing 12 is formed with a bracket 123, and the bracket 123 extends from the housing 12 for supporting the glue cartridge 15.

A drip tip 102 is detachably mounted on a front end of the glue cartridge 15. In some specific examples, the drip tip 102 is mounted on the front end of the glue cartridge 15 through use of a thread. In this example, an outer surface of the glue cartridge 15 is provided with a plurality of slots extending in front and rear directions, which not only reduces the weight of the glue cartridge 15, but also plays an antiskid role and prevents slipping of the glue cartridge when held in a human hand.

The locking mechanism 144 is disposed between the drive rod 142 and the transmission mechanism 143. In condition that the locking mechanism 144 is locked, the drive rod 142 is movable in one of the front and rear directions and is immovable in the other direction; in condition that the locking mechanism is unlocked, the drive rod 142 can slide freely in the front and rear directions. The locking mechanism 144 facilitates easy replacement of the glue cartridge 15 by the user and increases work continuity. The locking mechanism 144 is further provided with an unlocking mechanism 144*a* for unlocking, and the unlocking mechanism 144*a* is used for unlocking the locking mechanism 144, so that the drive rod 142 can slide freely in the front and rear directions. In an example, the unlocking mechanism 144*a* includes a button.

In order to make the applied force of the drive rod 142 squeezing the glue cartridge 15 uniform and continuous, a jacking head 142*a* is also disposed on a front end of the drive rod 142. The jacking head 142*a* may be a disc connected to one end of the drive rod 142 or formed at one end of the drive rod 142, and may be in any other shape or structure for easily squeezing the glue out of the glue sheet. The jacking head 142*a* is used for being in contact with the glue, and squeezing the glue under the push of the drive rod 142.

In this example, the drive rod 142 may be a screw rod with an external thread. The screw rod is further formed with a flat position that prevents the screw rod from rotating during the sliding process, that is, the external threads on the screw rod are discontinuous. A smooth plane is disposed on the screw rod along the first linear direction 101, and the smooth plane interrupts a continuous structure of the external threads, so that the drive rod will only slide but not rotate when driven by the rotating member of the drive rod 142.

The electric glue gun 100 further includes an operation switch supported by the housing 12 and movable in at least one direction, and the operation switch can be operated. The operation switch includes at least an operation state for stopping the motor from driving the drive rod forward.

In an alternative example, the operation switch is a trigger 16 which can be pressed and released. The motor 11 can be started in condition that the trigger is pressed to a first position, and the motor 11 can be stopped from driving the drive rod forward in condition that the trigger is released to a second position. It should be noted that in the present disclosure, the motor 11 stopping driving the drive rod forward refers to that the motor 11 exits the operating state of driving the drive rod forward and enters the braking state to perform braking until the motor stops rotating, or that the rotation speed of the motor naturally decreases due to resistance without forced braking until the motor stops rotating.

The electric glue gun 100 has a jog mode and a non-jog mode, and the user may switch between different modes for different work needs. In condition that the electric glue gun 100 is in the jog mode, a controller 41 controls the motor 11 to output rotation speed every preset duration, and the rotation speed of the motor may be a fixed rotation speed. The preset duration is set by the user selectively to meet the needs of the work. For example, when an advertising paper or billboard is mounted, the jog mode of the electric glue gun 100 is used, and in the jog mode, the electric glue gun 100 outputs glue every preset duration, and outputs glue on the advertising paper or billboard at intervals. In this way, the advertising paper or billboard can be mounted on a fixed object, and continuous glue outputting can be avoided, which reduces unnecessary waste.

Figure 4:
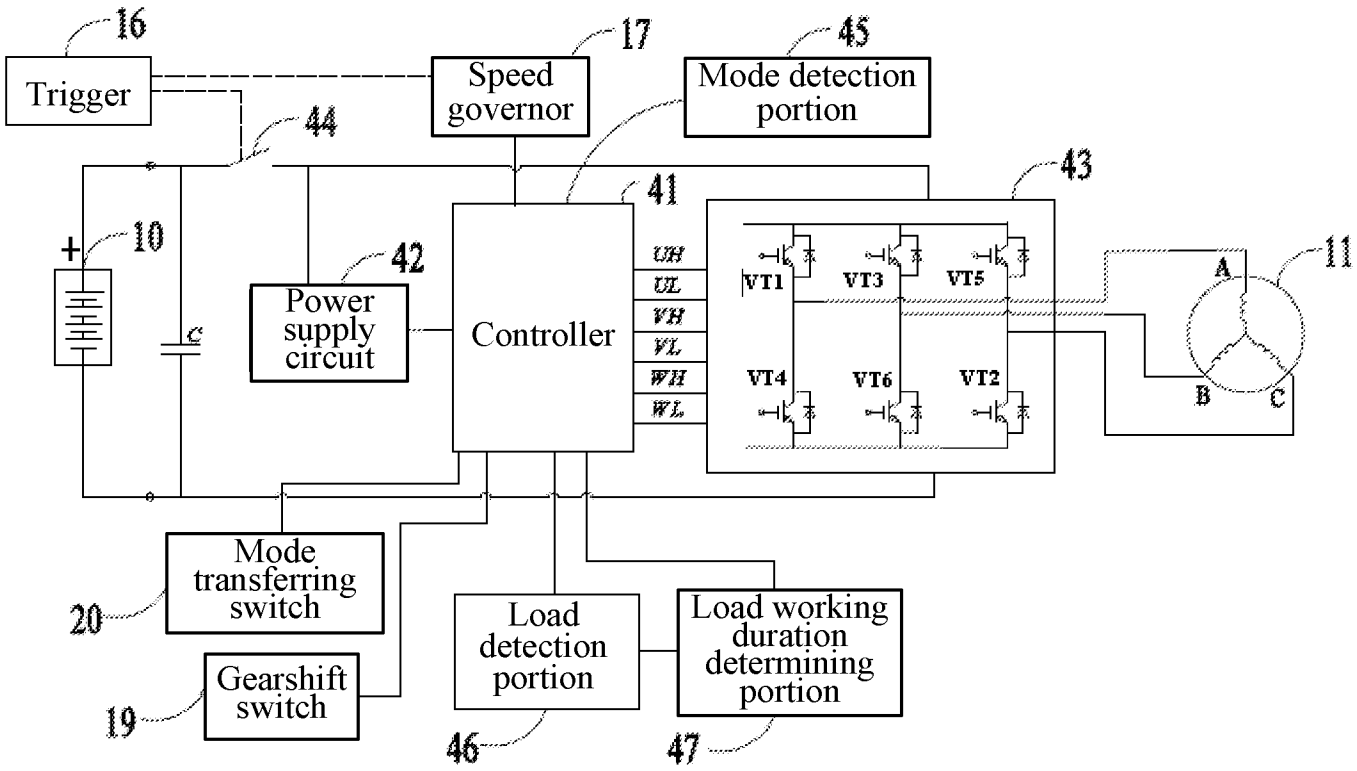
FIG. 4 is a schematic circuit diagram of an electric glue gun according to a first example.

The non-jog mode of the electric glue gun 100 includes a speed-adjustment mode. In the speed-adjustment mode, the user can arbitrarily adjust the rotation speed of the motor 11 of the electric glue gun 100 to make the electric glue gun 100 output different power. As shown in FIG. 4, the electric glue gun 100 is formed with or connected to a speed governor 17 for adjusting the glue squeezing rate, the speed governor 17 is connected in association with the trigger 16 and is electrically connected to the controller 41. The speed governor 17 is used for achieving the speed-adjustment mode of electric glue gun 100.

In an alternative example, the speed governor 17 includes a rod 171 and a sliding rheostat (not shown). Specifically, one end of the rod 171 is connected in association with the trigger 16, the other end of the rod 171 is connected to a movable end of the slide rheostat, and the slide rheostat accesses the circuit to be electrically connected to the controller 41. The rod 171 is capable of pushing the movable end of the sliding rheostat to move under a push of the trigger 16 to change the resistance of the sliding rheostat accessing the circuit. That is, when the trigger 16 is pressed with different strokes, a value of the resistance of the sliding rheostat accessing the circuit will change. The changed resistance value can be converted into different voltage signals by a related circuit, and the controller 41 controls the motor 11 to output different rotation speeds according to the different voltage signals. Specifically, the controller 41 obtains the rotation speed of the motor 11 desired by the operator according to the voltage signal of the speed governor 17 and a pre-stored voltage-rotation speed table or a voltage-rotation speed formula, so that the controller 41 outputs a control signal to control the motor 11 to output the rotation speed desired by the operator.

In this way, the operation switch is disposed to achieve the output of different speeds of the motor 11, so that the electric glue gun 100 outputs different power to meet the requirements of different working conditions.

In an alternative example, the non-jog mode of electric glue gun 100 further includes a constant-speed mode. In condition that the electric glue gun 100 is in the constant-speed mode, the motor 11 has a constant rotation speed without relying on a stroke of the trigger 16, so that a better rotation speed may be adjusted to and working at the better rotation speed, thus ensuring a better working effect, and at the same time, avoiding the fatigue caused by the operator keeping the trigger 16 in a hooking state for a long time and a reduction in the working effect and working quality due to the instability of the rotation speed of the motor 11 caused by the operator's hand trembling. In this way, even if the operator does not continuously hook the trigger, the motor 11 can output the constant rotation speed. In the constant-speed mode, the motor 11 can maintain the constant speed under a gear, which can avoid difficulty and inconvenience of the user to press the trigger all the time and unstable speed caused by the user's hand trembling. In the constant-speed mode, the quantity of glue output is even, and in some cases with aesthetic requirements, for example, when a door or a window is sealed with a glass, especially at a corner, the glue should not be accumulated, and the aesthetic should not be affected.

The electric glue gun 100 further includes a mode transferring switch 20 that is operatively triggered to make the electric glue gun 100 switch between the jog mode and the non-jog mode. In an alternative example, the mode transferring switch 20 is operatively triggered to make the electric glue gun 100 switch among the jog mode, the speed-adjustment mode, and the constant-speed mode.

In an alternative example, the mode transferring switch 20 of the electric glue gun 100 has a plurality of states corresponding to a plurality of modes, for example, in condition that the electric glue gun 100 has the jog mode and the speed-adjustment mode, the mode transferring switch 20 has a first state corresponding to the jog mode and a second state corresponding to the speed-adjustment mode.

In an alternative example, the electric glue gun 100 has the jog mode, the speed-adjustment mode and the constant-speed mode, the mode transferring switch 20 has a first state corresponding to the jog mode, a second state corresponding to the speed-adjustment mode, and a third state corresponding to the constant-speed mode.

In condition that the operator mounts an advertising paper or billboard, the operator triggers the mode transferring switch 20 to the first state, and uses the jog mode of the electric glue gun 100. In the jog mode, the electric glue gun 100 output glue every preset duration, and outputs glues on the advertising paper or billboard at intervals. In this way, the advertising paper or billboard can be mounted on the fixed object, and continuous glue output can be avoided, which reduces unnecessary waste.

In condition that the operator needs to adjust the rotation speed of motor 11 so that the electric glue gun 100 works in the speed-adjustment mode, the mode transferring switch 20 may be triggered to the second state, so that the motor 11 works at the rotation speed corresponding to the hooking magnitude of the trigger 16, and the electric glue gun 100 enters the speed-adjustment mode. If it is necessary to continue working at a present rotation speed after readjustment, the mode transferring switch 20 may be triggered again, so that the motor 11 can continue operating at the present rotation speed, a speed adjustment function of the trigger 16 is disabled, and the electric glue gun 100 enters the constant-speed mode.

In condition that the operator operates the trigger 16 to work continuously and needs to output continuous operation at a constant rotation speed, the third state of the mode transferring switch 20 can be triggered when the motor 11 is at the constant rotation speed. At this time, the controller 41 can obtain a signal of the present rotation speed of the motor of the electric glue gun 100, and controls the motor 11 to maintain operating at the rotation speed according to the signal, so that the electric glue gun 100 outputs constant power. At this time, the speed adjustment function of the trigger 16 is disabled. The controller 41 is disposed on a circuit board 18.

In this way, the mode transferring switch 20 is triggered, so that the electric glue gun 100 switches between the jog mode and at least one non-jog mode.

In an alternative example, the electric glue gun 100 further includes a memory (not shown) with a storage function, and data stored in the memory will not be lost after the memory is powered off. The memory is disposed in the housing 12, in some specific examples, the memory is electrically connected to the controller 41, and the memory may also be integrated in the controller 41. The memory can store a state of the electric glue gun 100 before powering off, the state includes a speed mode of the electric glue gun 100 and a rotation speed of the motor 11 before the powering off, and the speed mode includes the speed-adjustment mode, the constant-speed mode, and the jog mode.

The memory with a storage function after powering off is provided, so that the state of the electric glue gun 100 before the powering off can be recorded. When the electric glue gun 100 tool is restarted after the powering off, the electric glue gun 100 can still operate in the state before the powering off. In this way, for the same batch of working objects, the motor 11 operates at the same better rotation speed after the speed adjustment, which can ensure a more consistent and better working effect of the electric glue gun 100, and can also avoid the trouble of speed adjustment after the electric glue gun 100 is powered off.

In an alternative example, the electric glue gun 100 is further provided with a control mechanism for controlling the upper limit of the output power of the electric glue gun 100. The control mechanism includes a gearshift switch 19, the gearshift switch 19 is provided with a plurality of gears, and the motor 11 has different highest rotation speeds under the plurality of gears. For example, the gearshift switch 19 is provided with 6 gears, a first gear corresponds to the motor rotation speed of 0-4000 rpm, a second gear corresponds to the motor rotation speed of 0-8000 rpm . . . a sixth gear corresponds to the motor rotation speed of 0-24000 rpm, and when the trigger is in the same position in a different gear, a corresponding rotation speed of the motor is also different. In some specific examples, the gearshift switch 19 is a toggle button, and the gear of the output power of the electric glue gun 100 is adjusted through adjustment of the toggle button. It should be understood that the toggle button may be provided with a plurality of gears, can achieve the speed adjustment of the electric glue gun 100 in the plurality of gears, and each gear is provided with a highest rotation speed of the motor 11 to limit the maximum output power of the electric glue gun 100 in each gear, so as to avoid undesired excessive output power or rotation speed due to excessive amount of operation by the operator upon the trigger 16, provide safety, and provide better user experience for the operator. At the same time, the plurality of gears corresponds to different speed adjustment ranges, so that the user chooses different speed adjustment ranges according to different needs, which is convenient to operate.

The electric glue gun 100 further includes a power supply for supplying electric power to the electric glue gun 100. In some examples, the electric glue gun 100 is powered by a direct-current (DC) power supply, and more specifically, the electric glue gun 100 is powered by a battery pack 10, and the battery pack 10 cooperates with a corresponding power supply circuit, such as a DC-DC conversion chip for supplying electric power to the motor 11 and circuit components on a circuit board. Those skilled in the art should understand that the power supply is not limited to the scenario in which the battery pack 10 is used, and the electric power can be supplied to each circuit element through a commercial power and an alternating current (AC) power supply cooperating with the corresponding rectification, filtering and voltage regulating circuits.

In this example, the electric glue gun 100 is powered by the battery pack 10, and the battery pack 10 is detachably mounted to the electric glue gun 100. The battery pack 10 includes a shell and a battery cell. The battery cell is received in the shell for storing energy, and the battery cell can be repeatedly charged and discharged. The housing is formed with a connection interface for cooperating with a joint portion of the battery pack of the electric glue gun 100.

The operation of the electric glue gun 100 also depends on a circuit system. The circuit system includes a circuit component, the circuit component is disposed on the circuit board 18, and the circuit board 18 is located in the housing 12.

Referring to FIG. 4, the electric glue gun 100 according to a first example further includes the controller 41, a power supply circuit 42, and a driving circuit 43.

The controller 41 is used for controlling the operation process of the electric glue gun 100. In an alternative example, the controller 41 includes any one or a combination of a single-chip microcomputer or a microcontroller unit (MCU), an advanced reduced instruction set computing (RISC) machine (ARM) chip (advanced RISC) microprocessor, or advanced RISC machine), and a digital signal processor (DSP) chip (general digital signal processor).

The power supply circuit 42 is electrically connected to the controller 41 and is used to convert an electric energy from the power supply into an electric energy that can be used by the controller 41 and other circuit components. In this example, the power supply is the battery pack 10, so the power supply circuit 42 may include the DC-DC conversion chip. Those skilled in the art should understand that the power supply is not limited to the scenario in which the battery pack 10 is used. The electric power can be supplied to each circuit element through the commercial power and the AC power cooperating with the corresponding rectification, filtering and voltage regulating circuits. At this time, the power supply circuit includes rectification, filtering, and voltage regulation circuits.

In an alternative example, the electric glue gun 100 further includes a current switch 44 associated with the trigger 16, the current switch 44 is connected in series to a main circuit to allow or prohibit a current of the battery pack 10 from flowing to the electric glue gun 100. One end of the current switch 44 is electrically connected to a power supply terminal of the battery pack 10, and the other end of the current switch 44 is connected to the power supply circuit 42. In condition that the current switch 44 is not turned on, the power supply circuit 42 is powered off, the power supply circuit 42 cannot supply electric power to the controller 41, the controller 41 does not work, and the electric glue gun 100 does not work. In condition that the current switch 44 is turned on, the power supply circuit 42 is powered, and the controller 41 controls the operation of the motor 11 after obtaining electric energy from the power supply circuit 42. In an example, in condition that the trigger 16 is pressed to the first position, the current switch 44 is turned on and the motor 11 is started and, in condition that the current switch 44 is released to the second position, the motor 11 stops driving the drive rod forward.

In some other examples, the current switch 44 and the trigger 16 are not associated with each other. Instead, a trigger state detection device (not shown) is provided to detect the state of the trigger 16. The trigger state detection device is electrically connected to the controller 41, and the controller 41 controls the current switch to be turned on or off according to the state of the trigger detected by the trigger state detection device. In condition that the trigger 16 is from an initial state to being pressed to the first position, the controller 41 controls the current switch 44 to be turned on, and in condition that the trigger 16 is from a pressed state to being released to the second position, the controller 41 controls the current switch 44 to be turned off.

In this example, in order to reduce the size of the whole machine, the motor 11 is set as a brushless motor. Of course, other motors may also be used as the motor 11, which is not limited herein. In order to control the operation of the motor, the electric glue gun 100 also includes the driving circuit 43. The driving circuit 43 is electrically connected to the controller 41 and is used for controlling the operation of the motor 11. The driving circuit 43 is electrically connected to a three-phase winding of the brushless motor to drive a rotor of the brushless motor to operate, and the driving circuit 43 includes a switch element.

The driving circuit 43 shown in FIG. 4 includes switching elements VT1, VT2, VT3, VT4, VT5, and VT6, the switching element VT1 and the switching element VT4 are connected to a first phase winding A, the switching element VT3 and the switching element VT6 are connected to a second phase winding B, and the switching element VT5 and the switching element VT2 are connected to a third phase winding C. The switching elements VT1 to VT6 may be selected from field effect transistors, insulated gate bipolar transistor (IGBT) transistors, etc. A gate terminal of each switching element is separately electrically connected to a driving signal output terminal of the controller 41, and a drain or a source of each switching element is electrically connected to the winding of the brushless motor 17. The switching elements VT1-VT6 change the on state according to the driving signal outputted from the controller 41, thereby changing the voltage state of the battery pack 10 loaded on the windings of the brushless motor to drive the brushless motor to operate.

This example uses the brushless motor, which greatly reduces the size of the electric glue gun 100. At the same time, the drive rod 142 passes through the transmission mechanism 143, so that the structural complexity of the transmission mechanism 143 is also greatly reduced, the space occupied by transmission mechanism 143 is further reduced, the overall size of electric glue gun 100 is optimized as a whole, and the electric glue gun 100 as a whole is lighter, which is more convenient for the user to operate for a long time and reduces the fatigue of the user to operate for a long time.

However, in the non-jog mode (for example, in the speed-adjustment mode or constant-speed mode), when the electric glue gun stops the glue spraying work, the glue may flow out or leak out of the nozzle of the glue gun, producing nozzle dirt, which increases the additional labor cost and time for cleaning the glue.

In order to solve the above problems, in a first aspect of the present disclosure, an electric glue gun and a control method for an electric glue gun are provided, which can effectively avoid the above problems.

In this example, the controller 41 is configured to control the motor 11 to enable the drive rod to 142 return, i.e., move backward, by a preset distance after the motor 11 stops driving the drive rod forward. Specifically, in condition that the electric glue gun 100 is in the non-jog mode (for example, in the constant-speed mode or speed-adjustment mode), the controller 41 is configured to control the motor 11 to reverse to enable the drive rod 142 to return by the preset distance after the motor 11 stops driving.

As mentioned above, the motor stopping driving the drive rod forward refers to that the motor 11 exits an operating state of driving the drive rod forward and enters the braking state until the motor 11 stops rotating, or that the motor 11 exits a normal operating state without forced braking and the rotation speed of the motor naturally decreases gradually due to the resistance until the motor stops rotating. In an alternative example, the motor 11 is controlled by the trigger 16 to stop driving the drive rod forward. Of course, the motor 11 may also be controlled to stop driving the drive rod forward through detection of other signals.

In order to achieve the above objects, the electric glue gun 100 further includes a mode detection portion 45 for detecting whether the electric glue gun 100 is in the jog mode or the non-jog mode; the mode detection portion 45 is electrically connected to the controller 41.

In an example, the mode detection portion 45 includes a timing unit and the timing unit is used for determining a normal operating duration of the motor. Specifically, the timing unit is used for detecting each normal operating duration of the motor 13 and the controller 41 is configured to determine whether the electric glue gun 100 is in the jog mode or the non-jog mode according to the normal operating duration of the motor. The normal operating duration of the motor refers to a duration during which the motor maintains a normal speed, and does not include a duration during which the motor is in a braking state. In an alternative example, the normal operating duration of the motor is the operating duration of the motor from the time at zero speed to a time before braking and the timing unit is used for determining the operating duration of the motor 13 from the time at zero speed up to the time before braking. In an alternative example, the normal operating duration of the motor is a constant-speed operating duration of the motor and the timing unit is used for determining the operating duration of the motor 13 maintained at the normal operating speed each time from zero speed to the normal operating speed for the first time. The normal operating speed refers to the speed of the motor when the electric glue gun works normally.

In an alternative example, the controller 41 is configured to determine that the electric glue gun 100 is in the non-jog mode in condition that the normal operating duration of the motor is greater than or equal to the preset duration. Of course, the timing unit of the mode detection portion 45 can also start timing after the trigger 16 is released, and the timing duration is T. In condition that the timing duration T is greater than a preset threshold, the electric glue gun 100 is determined to be in the non-jog mode.

The controller 41 is configured to control the motor 11 to enable the drive rod 142 to return by the preset distance after determining that the electric glue gun 100 is in the non-jog mode and after the motor 11 stops driving the drive rod forward. In an alternative example, after the electric glue gun 100 is determined to be in the non-jog mode and after the motor 11 stops driving, the controller 41 controls the motor 11 to reverse to enable the drive rod 142 to return by the preset distance.

In an alternative example, the preset distance by which the drive rod 142 returns is positively correlated with the rotation speed of the motor 11. In this way, the preset distance by which the drive rod 142 returns is dynamically adjusted, that is, a reversal duration of the motor 11 is adjusted, so that the distance by which the drive rod 142 returns is positively correlated with the rotation speed of the electric glue gun 100, which can avoid the glue overflow phenomenon existing due to the fact that the drive rod 142 returns insufficiently, or looseness of the drive rod 142 and the excessive empty stroke of the drive rod 142 in the next boot due to the fact that the drive rod 142 returns excessively, and thus avoid a waste of time and energy.

Further, the electric glue gun 100 has a plurality of gears, the motor 11 has different highest rotation speeds under the plurality of gears, and the preset distances by which the drive rod 142 returns under the different gears are different.

Referring to the above, the gearshift switch 19 is provided with a plurality of gears, and the motor 11 has different highest rotation speeds under the plurality of gears. For example, the gearshift switch 19 is provided with 6 gears, a first gear corresponds to the motor rotation speed of 0-4000 rpm, a second gear corresponds to the motor rotation speed of 0-8000 rpm . . . a sixth gear corresponds to the motor rotation speed of 0-24000 rpm, and the higher the gear, the higher the corresponding highest motor rotation speed. When the trigger 16 is in the same position under different gears, the corresponding rotation speeds of the motor 11 are also different. In an alternative example, the preset distance by which the drive rod 142 returns enabled by the control of the controller 41 over the motor is positively correlated with the rotation speed of the motor 13. For example, when the gearshift switch 19 is in the first gear, the preset distance by which the drive rod 142 returns enabled by the control of the controller 41 over the motor is positively correlated with the gear of the gearshift switch 19, and the higher the gear, the greater the preset distance by which the drive rod 142 returns. For example, when the gearshift switch 19 is in the first gear, the drive rod 142 returns by 1 mm, when the gearshift switch 19 is in the second gear, the drive rod 142 returns by 2 mm, when the gearshift switch 19 is in the third gear, the drive rod 142 returns by 2.5 mm, when the gearshift switch 19 is in the fourth gear, the drive rod 142 returns by 3 mm, when the gearshift switch 19 is in the fifth gear, the drive rod 142 returns by 4.5 mm, and when the gearshift switch 19 is in the sixth gear, the drive rod 142 returns by 5.5 mm.

In another example, a duration from the time the trigger 16 is pressed to the time the trigger 16 is released is detected to determine whether the electric glue gun 100 is in the jog mode or the non-jog mode. For example, a proximity switch is provided on the handle 122 to detect whether the trigger 16 is in the pressed or released position, and the timing unit of the mode detection portion 45 can obtain the duration for the trigger 16 to switch between being pressed and being released according to the position of the trigger 16, so that the controller 41 can determine whether the electric glue gun 100 is in the jog mode or the non-jog state according to the duration. Of course, a formation switch and a signal switch, etc. may be used instead of the proximity switch.

According to the above descriptions, in the non-jog mode, in condition that the controller 41 of the electric glue gun 100 detects that the trigger is released, the motor 11 is controlled to reverse for a certain duration to enable the drive rod 142 to return by the preset distance, which can effectively avoid the glue overflow after the motor 11 stops driving the drive rod forward and releases.

However, a problem will exist, in some cases, in condition that the electric glue gun 100 has no glue and operates with no load (for example, in condition that the glue cartridge is empty), it is not necessary to make the drive rod 142 return after the motor 11 stops driving the drive rod forward, reducing unnecessary operations and saving energy while simplifying operation.

In order to solve the above problem, in this example, the electric glue gun 100 is further provided with a load detection portion 46 for detecting a load working event of the electric glue gun 100. An output terminal of the load detection portion 46 is electrically connected to the controller 41. The controller 41 determines whether the load working event occurs in the electric glue gun 100 according to a detection result of the load detection portion 46. After the load working event is determined to occur in the electric glue gun 100 and the motor 11 stops driving the drive rod forward, the motor 11 is controlled to reverse so that the drive rod 142 returns by the preset distance and the glue does not overflow after glue spraying is stopped.

Figure 5:
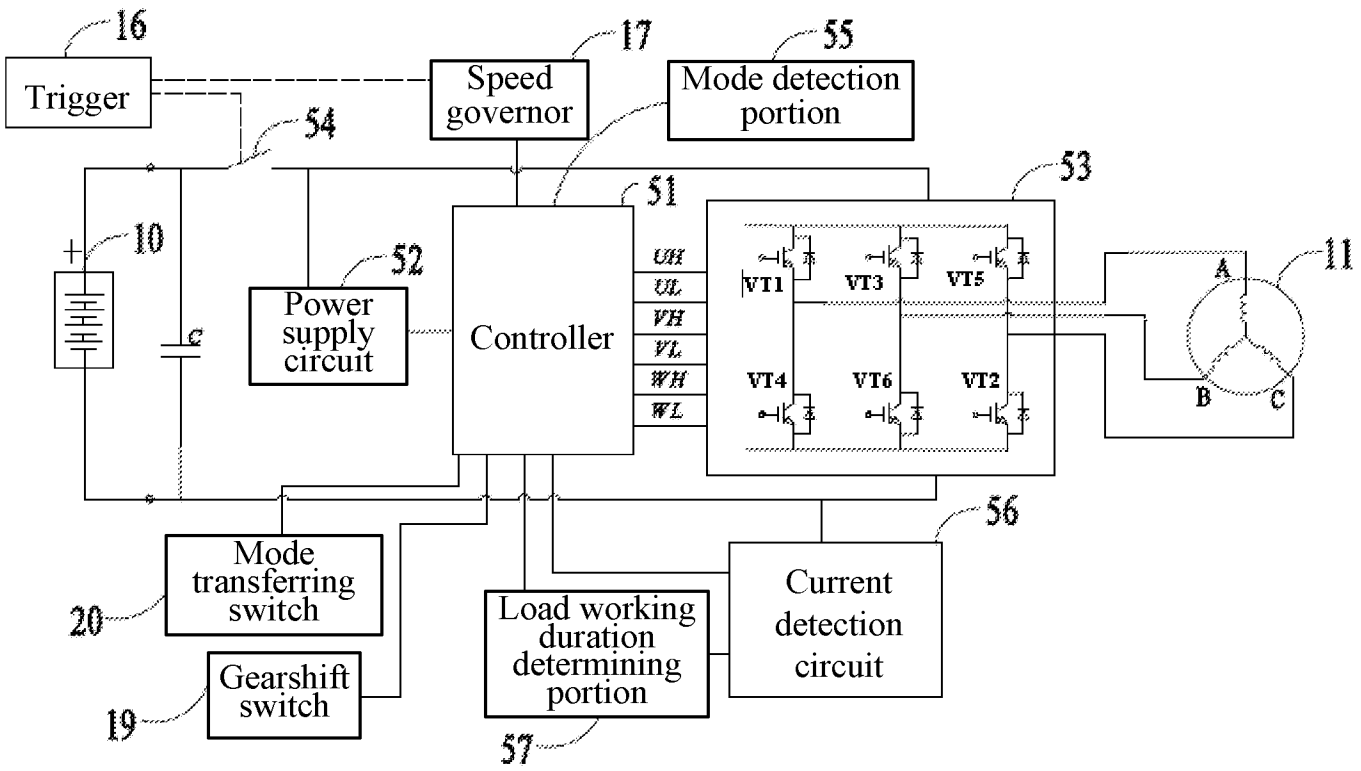
FIG. 5 is a schematic circuit diagram of an electric glue gun according to a second example.

Referring to FIG. 5, a circuit system of an electric glue gun 100 according to an example includes a controller 51, a power supply circuit 52, a driving circuit 53, a current switch 54, a mode detection portion 55, a power supply device 10, the motor 11, the trigger 16, the speed governor 17, the gearshift switch 19, and the mode transferring switch 20. The above-mentioned circuit components are the same as or similar to those in the foregoing examples, and details are not repeated here.

In a first example, the load detection portion 46 described in FIG. 4 may specifically be a current detection circuit 46 shown in FIG. 5, which detects whether the electric glue gun 100 is working under load by detecting a current flowing to the motor 11. Specifically, the current detection circuit 46 is electrically connected to a main circuit for detecting a current flowing to a winding of the motor 11. In condition that the drive rod 142 pushes the glue to move, the drive rod 142 will receive the reaction force of the glue, a load of the motor 11 will be larger than the empty load, and a current at this time will be larger than a current when no load is provided, and therefore, whether the electric glue gun 100 has a load working event can be detected through detection of the current flowing to the motor 11. The output terminal of the current detection circuit 46 is electrically connected to the controller 41, the controller 41 determines whether a load working event occurs in the electric glue gun 100 according to the detection result of the current detection circuit 46, and after the load working event is determined to occur in the electric glue gun 100 and the motor 11 stops driving the drive rod forward, the motor 11 is controlled to enable the drive rod 142 to return by the preset distance.

Specifically, the controller 41 compares a detected current value from the current detection circuit 46 with a preset current threshold value, the preset current threshold value corresponds to an inflection point of a current change, that is, the current when the load occurs. In response to determining that the current detection value is greater than the preset current threshold value, it is determined that the load working event has occurred in the electric glue gun 100, and in response to determining that the current detection value is not greater than the preset current threshold value, it is determined that no load working event has occurred in the electric glue gun 100. In condition that the glue spraying duration has not occurred, the motor 11 does not need to be controlled to enable the drive rod 142 to return by the preset distance.

In some examples, the electric glue gun 100 detects whether the motor stops driving the drive rod forward through a trigger state detection device. The trigger state detection device is used for detecting whether the trigger 16 is in a pressed state or a released state. In condition that the trigger 16 is in the released state, the motor 11 stops driving the drive rod forward. The trigger state detection device is electrically connected to the controller 41, and sends the detection result to the controller 41. In condition that the load detection portion 46 detects that the load working event has occurred in the electric glue gun 100, and the trigger state detection device detects that the trigger 16 is released, the controller 41 controls the motor 11 to enable the drive rod 142 to return by the preset distance.

The trigger state detection device may be a circuit comprised of electronic components. For example, the trigger state detection device may be a trigger state detection circuit comprised of a signal switch associated with the trigger 16, and the controller 41 determines a state of the trigger 16 according to a state of the signal switch; the trigger state detection device may be a trigger state detection circuit comprised of a sliding rheostat associated with the trigger, and the controller 41 determines the state of the trigger 16 according to a voltage signal converted from a value of resistance of the sliding rheostat accessing the circuit; the trigger state detection device may be a sensor that can sense the trigger state, such as a position sensor that detects the position of the trigger, a stroke switch, a proximity switch, and a signal switch associated with the trigger; of course, the trigger state detection device may also be used with the speed governor 17 mentioned above, in condition that the trigger 16 is released or pressed, and the voltage signal is different or a change of the voltage signal is different. In this way, whether the trigger 16 is in the pressed state or the released state is detected.

In other examples, the controller 41 determines that the motor 11 is in a driving stopped state when the motor 11 exits the normal operating state and enters the braking state or the motor exits the normal operating state and is in the natural stopped state. In condition that the load working event of the electric glue gun 100 is detected by the load detection portion 46 and the motor 11 is determined to be in the driving stopped state, the controller 41 controls the motor 11 to reverse to enable the drive rod 142 to return by the preset distance.

In an alternative example, the electric glue gun 100 further includes a load working duration determining portion 47 used for determining a load working duration of the electric glue gun 100 (that is, the duration of glue spraying of the electric glue gun 100), and the controller 41 controls the motor 11 to reverse for a preset duration according to the load working duration. The load working duration of the electric glue gun 100 is positively correlated with the preset duration of reversal of the motor 11. In an alternative example, the load working duration determining portion 47 is connected to the load detection portion 46 and is configured to determine the load working duration according to a result of the load detection portion 46.

In this way, according to the load working duration of the electric glue gun 100, reversal duration of the motor 11 is dynamically adjusted to enable the drive rod to return by different distances, and the distance by which the drive rod 142 returns is positively correlated with the load working duration of the electric glue gun 100, which can avoid that the drive rod 142 returns by a fixed distance as the durations of glue spraying are different, which may thus avoid glue dripping due to the fact that the drive rod 142 returns insufficiently, or looseness of the drive rod 142 or the electric glue gun and the excessive empty stroke of the drive rod 142 in the next boot due to the fact that the drive rod 142 returns excessively, and then avoid a waste of time and energy.

The present disclosure further provides a control method for the electric glue gun 100, and the method includes steps described below.

It is determined whether the electric glue gun is in a jog mode or a non-jog mode.

It is determined whether a load working event occurs in the electric glue gun.

In response to determining that the load working event has occurred in the electric glue gun, the electric glue gun is in the non-jog mode and the motor stops driving the drive rod forward, the motor is controlled to reverse to enable the drive rod to return by a preset distance.

In the example of the present disclosure, it is determined whether the electric glue gun 100 is in the jog mode or the non-jog mode, so that the drive rod is not moved backward in the jog mode, and the drive rod is moved backward in the non-jog mode, which is more suitable for the operating habits of the user.

In a first example, a control method for the electric glue gun 100 includes steps described below.

A mode of the electric glue gun is identified.

It is determined whether the electric glue gun is in a jog mode or a non-jog mode.

A current flowing to the motor is acquired.

In response to determining that the current flowing to the motor is greater than or equal to a preset current threshold value, the electric glue gun is determined to have the load working event.

In response to determining that the electric glue gun has the load working event, the electric glue gun is in the non-jog mode and the motor stops driving the drive rod forward, the motor is controlled to reverse to enable the drive rod to return by the preset distance.

Figure 6:
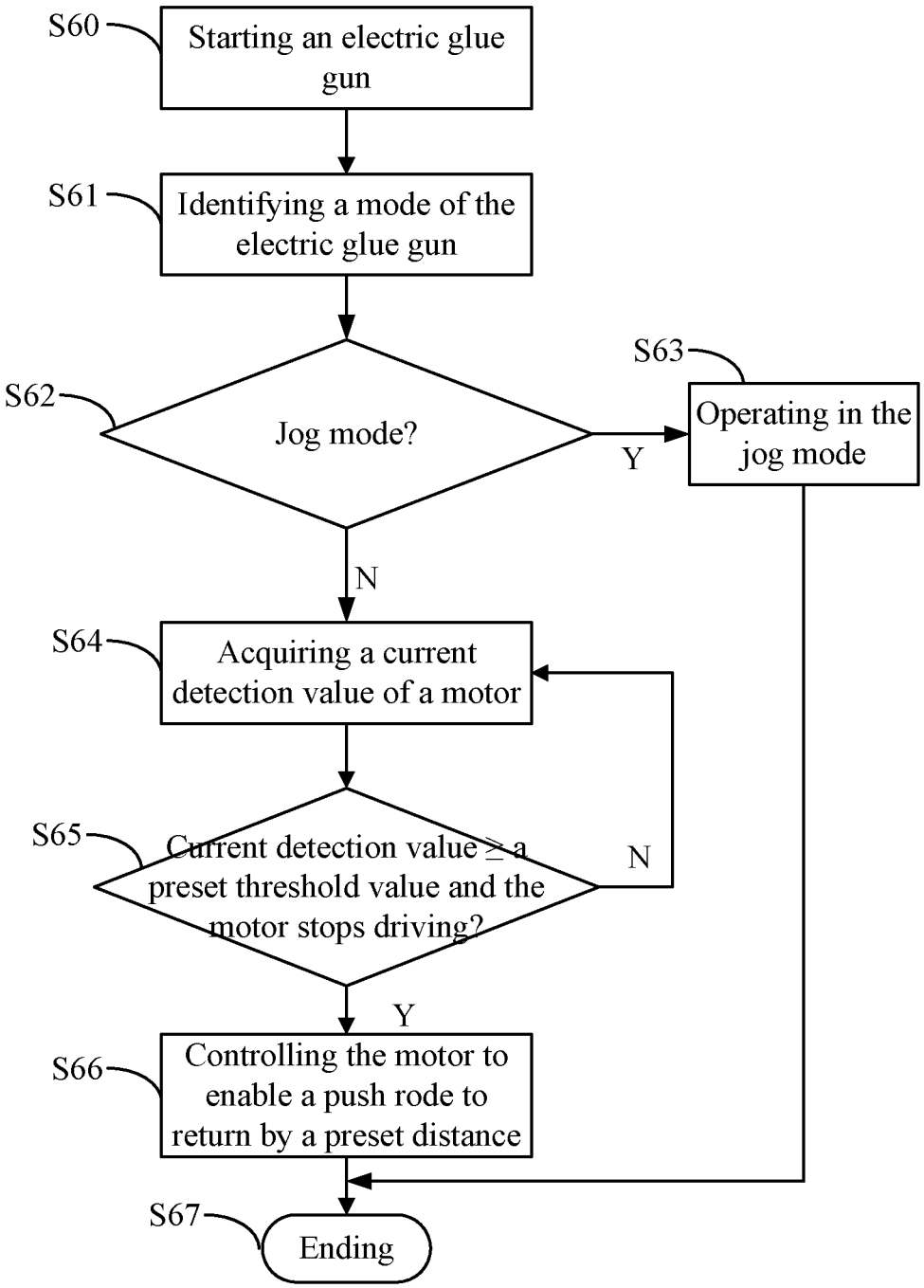
FIG. 6 is a flowchart of a control method for the electric glue gun shown in FIG. 5.

Referring to FIG. 6, In an alternative example, a specific control method for the electric glue gun 100 is performed according to the steps described below:

In step S60, an electric glue gun is started.

The battery pack 10 is mounted to the electric glue gun 100, the trigger 16 is pressed to start the electric glue gun 100, and the controller 51 is powered on.

In step S61, a mode of the electric glue gun is identified.

As described above, the mode of the electric glue gun 100 is detected by the mode detection portion 55, and the controller 51 identifies the mode of the electric glue gun according to the result of the mode detection portion 55.

In step S62, it is determined whether the electric glue gun 100 is in the jog mode.

The controller 51 determines whether the electric glue gun 100 is in the jog mode, if the electric glue gun 100 is in the jog mode, the process goes to step S63, and the electric glue gun 100 operates in the jog mode until the end, and if the electric glue gun 100 is not in the jog mode, the process goes to step S64.

In step S63, the electric glue gun 100 operates in the jog mode.

In response to determining that the electric glue gun 100 is in the jog mode, operation is continued in an original mode until the end, and the motor is not controlled to enable the drive rod to return by the preset distance.

In step S64, a current of the motor is acquired.

In response to determining that the electric glue gun 100 is not in the jog mode but in the non-jog mode, the current detection circuit 56 detects the current flowing to the motor in real time, and the controller 51 acquires the current flowing to the motor 11 from the current detection circuit 56.

In step S65, whether the current detection value is greater than or equal to a preset threshold value and whether the motor stops driving are determined.

The controller 51 compares the acquired current detection value of the motor with the preset threshold value to determine whether the current detection value is greater than or equal to the preset threshold value. In condition that the current detection value is greater than or equal to the preset threshold value, the electric glue gun 100 is determined to have the load working event; in condition that the current detection value is not greater than or equal to the preset threshold value, the electric glue gun 100 is determined not to have the load working event.

At the same time, whether the motor 11 stops driving the drive rod forward is determined. In an alternative example, a trigger state is monitored in real time by the trigger state detection device, and the controller 51 detects the trigger state by the trigger state detection device; In an alternative example, in condition that the motor exits the operating state of driving the drive rod forward and enters the braking state or that the motor 11 exits the operating state of driving the drive rod forward and naturally stops, the controller determines that the motor 11 stops driving the drive rod forward.

In response to determining that the load working event has occurred in the electric glue gun 100 and the motor 11 is in the state of stopping driving the drive rod forward, the process goes to step S66, otherwise the process goes to step S64.

In step S66, the motor is controlled to reverse to enable the drive rod to return by the preset distance.

After it is determined that the load working event has occurred in the electric glue gun 100 and the motor 11 is in the state of stopping driving the drive rod forward, the controller 51 controls the motor 11 to reverse, and stops the motor from rotating after the drive rod 142 returns by the preset distance. In actual operation, the motor 11 can be controlled to reverse for the preset duration at a certain rotation speed to enable the drive rod 142 to return by the preset distance, and the preset duration may be a fixed value preset by the user according to actual needs; the preset duration may also be a variable value, and as mentioned above, the motor 11 may reverse for different durations according to different gears of the gearshift switch 19 to enable the drive rod 142 to return by different distances. The preset duration may also be determined by a load working duration of the electric glue gun 100, and the details are described below.

In step S67, the process ends.

In an alternative example, the electric glue gun 100 further includes a load working duration determining portion 57 for determining the load working duration of the electric glue gun 100 (that is a duration of glue spraying of the electric glue gun 100), and the controller 51 controls the motor 11 to reverse for the preset duration according to the load working duration. The load working duration of the electric glue gun 100 is positively correlated with the preset duration of reversal of the motor 11.

Referring to FIG. 5, in an alternative example, an input terminal of the load working duration determining portion 57 is electrically connected to the current detection circuit 56, and an output terminal of the load working duration determining portion 57 is electrically connected to the controller 51. The load working duration determining portion 57 determines the load working duration according to a detection result of the current detection circuit 56.

The load working duration determining portion 57 determines the load working duration according to a current change detected by the current detection circuit 56. In an example, the load working duration determining portion 57 may specifically include a comparator and a timer or a counter. The load working duration determining portion 57 acquires a current detection value of the current detection circuit 56, and the comparator of the load working duration determining portion 57 compares the current detection value with the preset current threshold value. In response to determining that the current detection value is greater than or equal to the preset current threshold value, the timer or counter of the load working duration determining portion 57 starts timing, and does not stop timing or counting until the motor stops driving the drive rod forward, and the result of the timer or counter is sent to the controller 51 as the load working duration. The controller 51 acquires the load working duration determined by the load working duration determining portion 57 and determines the preset duration of reversal of the motor by a formula or table lookup according to the load working duration, and then controls the motor 57 to reverse for the preset duration to enable the drive rod 142 to return by the preset distance.

Figure 7:
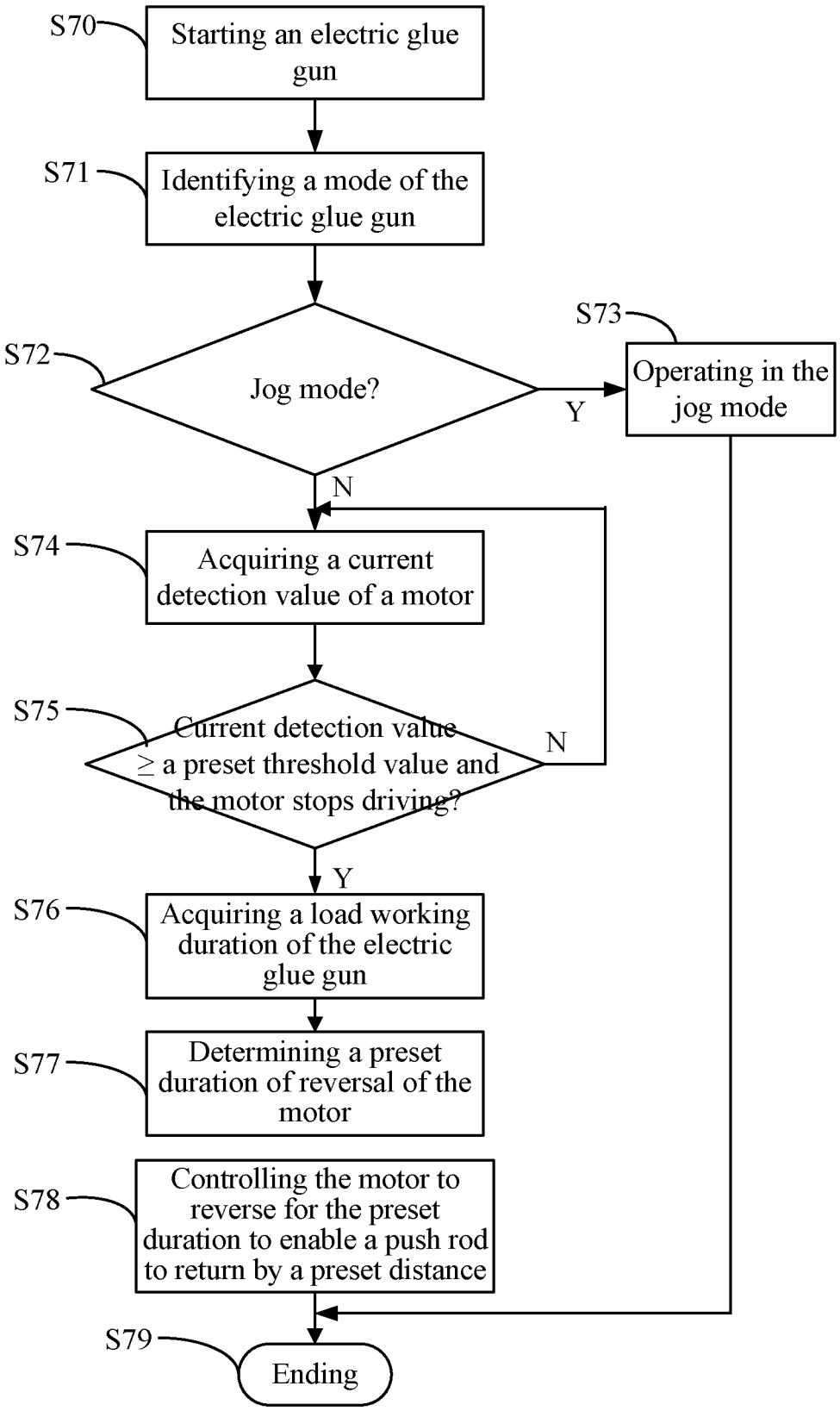
FIG. 7 is a flowchart of another control method for the electric glue gun shown in FIG. 5.

Referring to FIG. 7, in a second example, a control method for the electric glue gun 100 is described below.

In step S70, an electric glue gun is started.

The battery pack 10 is mounted to the electric glue gun 100, the trigger 16 is pressed to start the electric glue gun 100, and the controller 51 is powered on.

In step S71, a mode of the electric glue gun is identified.

As described above, the mode of the electric glue gun 100 is detected by the mode detection portion 55, and the controller 51 identifies the mode of the electric glue gun according to the result of the mode detection portion 55.

In step S72, it is determined whether the electric glue gun 100 is in the jog mode.

The controller 51 determines whether the electric glue gun 100 is in the jog mode, and if the electric glue gun 100 is in the jog mode, the process goes to step S73, and the electric glue gun 100 operates in the jog mode until the end, and if the electric glue gun 100 is not in the jog mode, the process goes to step S74.

In step S73, the electric glue gun 100 operates in the jog mode.

In response to determining that the electric glue gun 100 is in the jog mode, operation is continued in an original mode until the end, and the motor is not controlled to enable the drive rod to return by the preset distance.

In step S74, a current of the motor is acquired.

In response to determining that the electric glue gun 100 is not in the jog mode but in the non-jog mode, the current detection circuit 56 detects the current flowing to the motor in real time, and the controller 51 acquires the current flowing to the motor 11 from the current detection circuit 56.

In step S75, whether the current detection value is greater than or equal to a preset threshold value and whether the motor stops driving the drive rod forward are determined.

The controller 51 compares the acquired current detection value of the motor with the preset threshold value to determine whether the current detection value is greater than or equal to the preset threshold value. In condition that the current detection value is greater than or equal to the preset threshold value, the electric glue gun 100 is determined to have the load working event, and in condition that the current detection value is not greater than or equal to the preset threshold value, the electric glue gun 100 is determined not to have the load working event.

At the same time, whether the motor 11 stops driving the drive rod forward is determined. In an alternative example, a trigger state is monitored in real time by the trigger state detection device, and the controller 51 detects the trigger state by the trigger state detection device; In an alternative example, in condition that the motor exits the operating state of driving the drive rod forward and enters the braking state, or that the motor 11 exits the operating state of driving the drive rod forward and naturally stops, the controller determines that the motor 11 stops driving.

In response to determining that the load working event has occurred in the electric glue gun 100 and the motor 11 is in the driving stopped state, the process goes to step S76, otherwise, the process goes to step S74.

In step S76, the load working duration of the electric glue gun 100 is acquired.

The load working duration determining portion 57 determines the load working duration according to a current change detected by the current detection circuit 56.

In an example, the load working duration determining portion 57 may specifically include a comparator and a timer or a counter. The load working duration determining portion 57 acquires a current detection value of the current detection circuit 56. In response to determining that the current detection value is greater than or equal to the preset current threshold value, the timer or counter of the load working duration determining portion 57 starts timing, and does not stop timing or counting until the trigger is released, and the result of the timer or counter is sent to the controller 51 as the load working duration. The controller 51 acquires the load working duration determined by the load working duration determining portion 57.

In step S77, the preset duration of reversal of the motor is determined.

The controller 51 determines the preset duration of reversal of the motor by a formula or table lookup according to the load working duration. The preset duration is positively correlated with the load working duration, that is, the longer the load working duration, the longer the preset duration of reversal of the motor. In this way, the reversal duration of the motor 11 is dynamically adjusted so that the returned distance of the drive rod 142 is positively correlated with the load working duration of the electric glue gun 100, which can avoid the glue overflow phenomenon existing due to the fact that the drive rod 142 returns insufficiently, or looseness of the drive rod 142 or glue gun and the excessive empty stroke of the drive rod 142 in the next boot due to the fact that the drive rod 142 returns excessively, and thus avoid a waste of time and energy.

In step S78, the motor is controlled to reverse for the preset duration to enable the motor to return by the preset distance.

The controller 51 controls the motor 11 to reverse for the determined preset duration of reversal of the motor and then stops the motor from driving, so that the drive rod 142 returns by the preset distance.

In step S79, the process ends.

Figure 8:
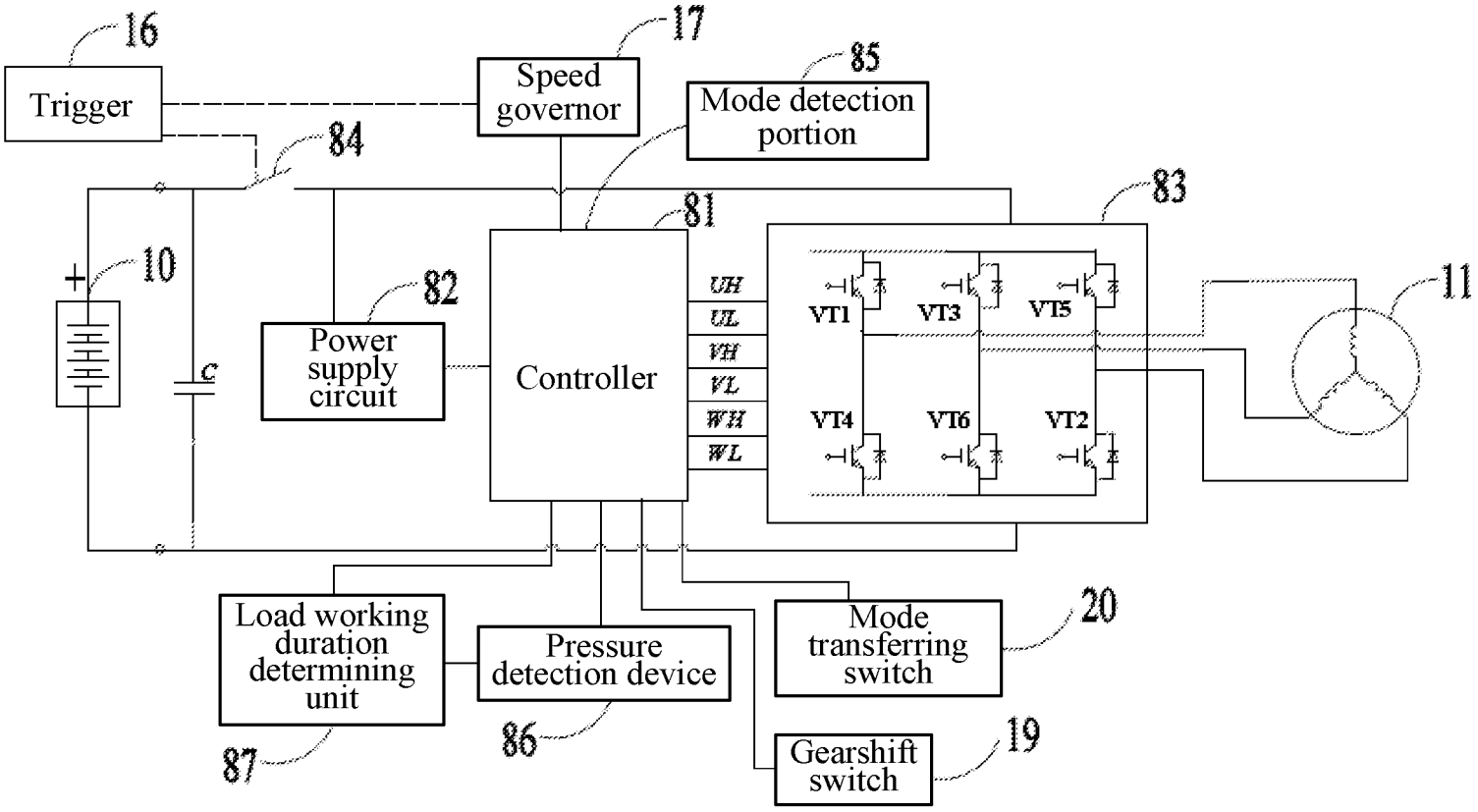
FIG. 8 is a schematic circuit diagram of an electric glue gun according to a third example.

Referring to FIG. 8, a circuit system of the electric glue gun 100 in another example includes: a controller 81, a power supply circuit 82, a driving circuit 83, a current switch 84, a mode detection portion 85, the battery pack 10, the motor 11, the trigger 16, the speed governor 17, the gearshift switch 19, and the mode transferring switch 20. The above-mentioned circuit components are the same as or similar to those in the foregoing examples, and details are not repeated here.

In this example, the load detection portion 46 may specifically be a pressure detection device 86 which detects whether the electric glue gun 100 has a load working event through detection of a pressure in the glue cartridge 15. Specifically, the pressure detection device 86 is, but is not necessarily, mounted in the glue cartridge 15, and the pressure detection device 86 may specifically be a pressure sensor capable of sensing a change in pressure. For example, the pressure sensor may be mounted on the jacking head 142*a* at the front end of the drive rod 142, and can sense whether the jacking head 142*a* at the front end of the drive rod 142 is in contact with the glue and receives pressure from the glue. In condition that the electric glue gun 100 is in a no-load condition, since no glue is in the glue cartridge, in this case, when the electric glue gun 100 is working, the pressure of the pressure sensor at the front end of the drive rod 142 is different from the pressure of the pressure sensor when the electric glue gun 100 works with full load. Therefore, the pressure detection device 86 can detect the pressure in the glue cartridge so that whether the electric glue gun 100 is working under load. An output terminal of the pressure detecting device 86 is connected to the controller 41. The controller 41 determines whether a load working event occurs in the electric glue gun 100 according to a detection result of the pressure detecting device 86, and after it is determined that the load working event occurs in the electric glue gun and the trigger is released, controls the motor 11 to reverse for the preset duration.

The present disclosure further provides a control method for the electric glue gun 100 according to a third example. The method includes steps described below.

A mode of the electric glue gun is identified.

It is determined whether the electric glue gun is in a jog mode or a non-jog mode.

A pressure detected in the glue cartridge is acquired.

In response to determining that the pressure in the glue cartridge is greater than or equal to a preset pressure, the load working event is determined to occur in the electric glue gun.

In response to determining that the load working event has occurred in the electric glue gun and the motor is in the state of stopping driving the drive rod forward, the motor is controlled to reverse to enable the drive rod to return by the preset distance.

Figure 9:
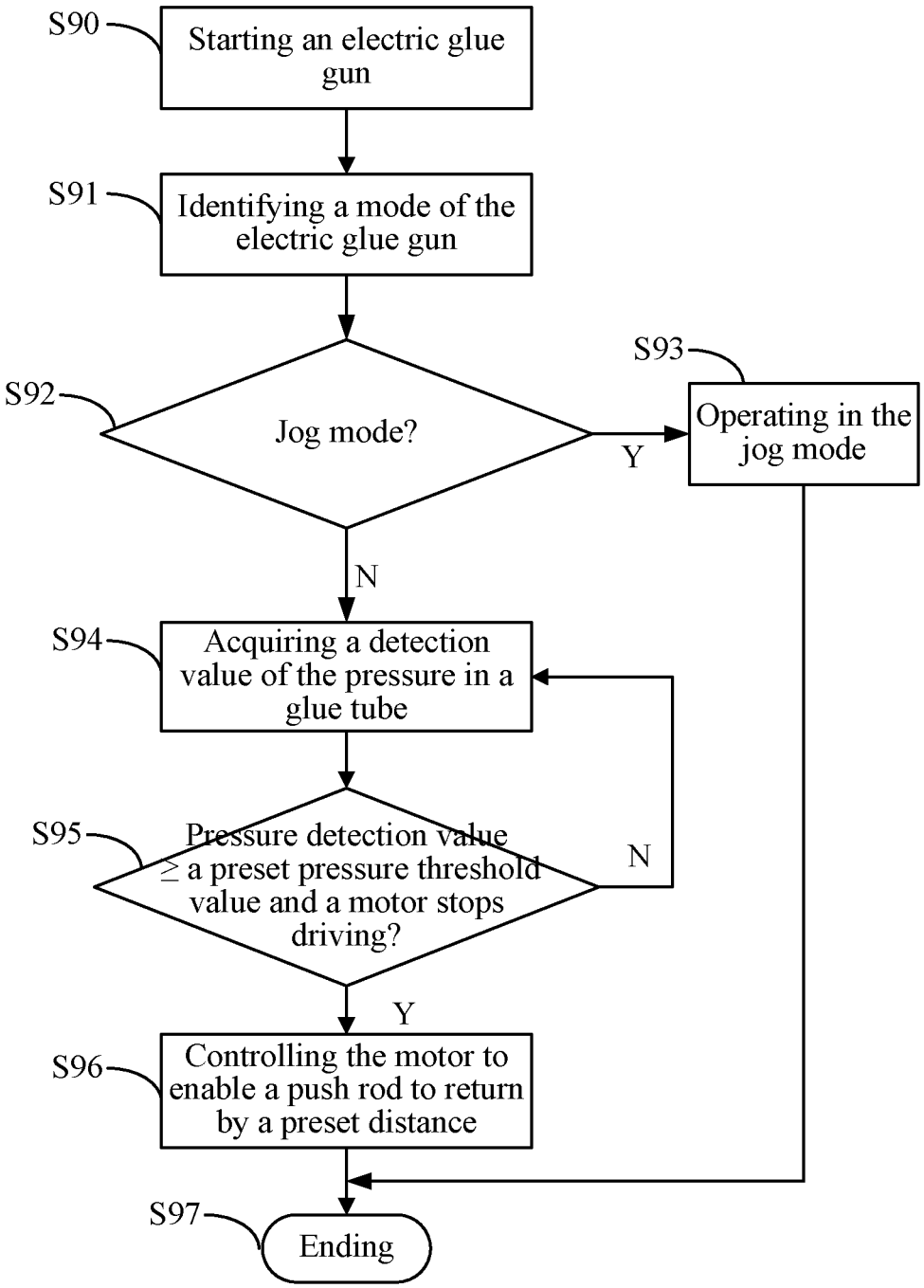
FIG. 9 is a flowchart of a control method for the electric glue gun shown in FIG. 8 according to an example.

Referring to FIG. 9, specifically, the control method for the electric glue gun 100 according to the third example described above specifically includes steps described below.

In step S90, the electric glue gun is started.

The battery pack 10 is mounted to the electric glue gun 100, the trigger 16 is pressed to start the electric glue gun 100, and the controller 81 is powered on.

In step S91, the mode of the electric glue gun is identified.

As described above, the mode of the electric glue gun 100 is detected by the mode detection portion 85, and the controller 81 identifies the mode of the electric glue gun according to the result of the mode detection portion 85.

In step S92, it is determined whether the electric glue gun 100 is in the jog mode.

The controller 81 determines whether the electric glue gun 100 is in the jog mode according to the determination of the mode detection portion 85, if the electric glue gun 100 is in the jog mode, the process goes to step S93, and the electric glue gun 100 operates in the jog mode until the end, and if the electric glue gun 100 is not in the jog mode, the process goes to step S94.

In step S93, it is determined whether the electric glue gun 100 operates in the jog mode.

In response to determining that the electric glue gun 100 is in the jog mode, operation is continued in the jog mode until the end, and the motor is not controlled to enable the drive rod to return by the preset distance.

In step S94, a detection value of the pressure in the glue cartridge is acquired.

The pressure detection device 86 detects the pressure in the glue cartridge 15 in real time. The pressure detection device 86 may be a pressure sensor. The pressure sensor is mounted at the front end of the drive rod 142 and can sense whether the front end of the drive rod 142 is in contact with the glue and receives the pressure from the glue. The controller 81 acquires the pressure detection value of the pressure sensor from the pressure detection device 86.

In step S95, whether the pressure detection value is greater than or equal to a preset pressure threshold value and whether the motor stops driving the drive rod forward are determined.

The controller 81 compares the acquired pressure detection value with the preset pressure threshold value to determine whether the current detection value is greater than or equal to the preset current threshold value. In condition that the pressure detection value is determined to be greater than or equal to the preset current threshold value, the electric glue gun 100 is determined to have the load working event; in condition that the pressure detection value is determined not to be greater than or equal to the preset current threshold value, the electric glue gun 100 is determined not to have the load working event.

At the same time, whether the motor 11 stops driving the drive rod forward is determined. In an alternative example, a trigger state is monitored in real time by the trigger state detection device, and the controller 81 detects the trigger state by the trigger state detection device; In an alternative example, in condition that the motor 11 exits the operating state of driving the drive rod forward and enters the braking state, or the motor 11 exits the operating state of driving the drive rod forward and naturally stops, the controller determines that the motor 11 stops driving.

In response to determining that the load working event has occurred in the electric glue gun 100 and the motor 11 is in the driving stopped state, the process goes to step S96, otherwise, the process goes to step S94.

In step S96, the motor is controlled to enable the motor to return by the preset distance.

After it is determined that the load working event has occurred in the electric glue gun 100 and the motor 11 stops driving the drive rod forward, the controller 81 controls the motor 11 to enable the drive rod 142 to return by the preset distance. In actual operation, the motor 11 can be controlled to reverse for the preset duration at a certain rotation speed to enable the drive rod 142 to return by the preset distance, and the preset duration may be a fixed value preset by the user according to actual needs. The preset duration may also be a variable value, and as mentioned above, the motor 11 may reverse for different durations according to different gears of the gearshift switch 19 to enable the drive rod 142 to return by different distances. The preset duration may also be determined by a load working duration of the electric glue gun 100, and the details are described below.

In step S97, the process ends.

Referring to FIG. 8, In an alternative example, the electric glue gun 100 further includes a load working duration determining portion 87, an input terminal of the load working duration determining portion 87 is electrically connected to the pressure detection device 86, and an output terminal of the load working duration determining portion 87 is electrically connected to the controller 81. The load working duration determining portion 87 determines the load working duration according to a detection result of the pressure detection device 86.

Specifically, the load working duration determining portion 87 determines the load working duration according to a pressure change detected by the pressure detection device 86. In an example, the load working duration determining portion 87 may specifically include a comparator and a timer or a counter. The load working duration determining portion 87 acquires the pressure detection value of the pressure detection device 86, and the comparator of the load working duration determining portion 87 compares the pressure detection value with the preset pressure threshold value. In response to determining that the pressure detection value is greater than or equal to the preset pressure threshold value, the timer or counter of the load working duration determining portion 87 starts timing, and does not stop timing or counting until the motor stops driving the drive rod forward, and the result of the timer or counter is sent to the controller 81 as the load working duration. The controller 81 acquires the load working duration determined by the load working duration determining portion 87 and determines the preset duration of reversal of the motor by a formula or table lookup according to the load working duration, and then controls the motor 11 to reverse for the preset duration to enable the drive rod 142 to return by the preset distance.

Figure 10:
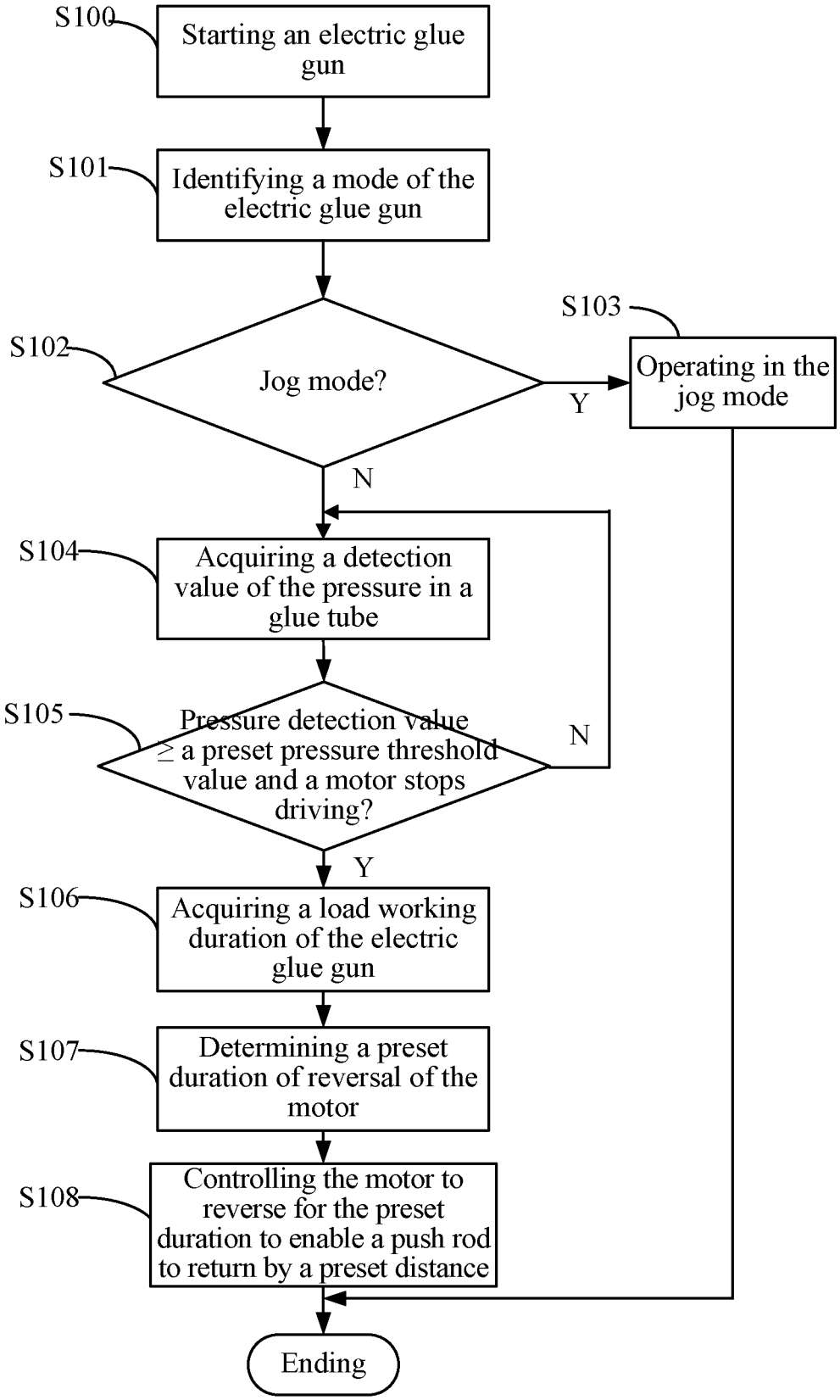
FIG. 10 is a flowchart of a control method for the electric glue gun shown in FIG. 8 according to another example.

Referring to FIG. 8 and FIG. 10, a control method for the electric glue gun 100 according to a fourth example is similar to the control method for the electric glue gun 100 according to the second example except that the load detection portion 46 may be a pressure detection device 86 instead of the current detection circuit 56. The specific process is described below.

In step S100, the electric glue gun is started.

The battery pack 10 is mounted to the electric glue gun 100, the trigger 16 is pressed to start the electric glue gun 100, and the controller 81 is powered on.

In step S101, the mode of the electric glue gun is identified.

As described above, the mode of the electric glue gun 100 is detected by the mode detection portion 85, and the controller 81 identifies the mode of the electric glue gun according to the result of the mode detection portion 85.

In step S102, it is determined whether the electric glue gun 100 is in the jog mode.

The controller 81 determines whether the electric glue gun 100 is in the jog mode according to the determination of the mode detection portion 85, and if the electric glue gun 100 is in the jog mode, the process goes to step S103, and the electric glue gun 100 operates in the jog mode until the end, and if the electric glue gun 100 is not in the jog mode, the process goes to step S104.

In step S103, the electric glue gun 100 operates in the jog mode.

In response to determining that the electric glue gun 100 is in the jog mode, operation is continued in the jog mode until the end, and the motor is not controlled to enable the drive rod to return by the preset distance.

In step S104, a detection value of the pressure in the glue cartridge is acquired.

The pressure detection device 86 detects the pressure in the glue cartridge 15 in real time. The pressure detection device 86 may be a pressure sensor. The pressure sensor is mounted at the front end of the drive rod 142 and can sense whether the front end of the drive rod 142 is in contact with the glue and receives the pressure from the glue. The controller 81 acquires the pressure detection value of the pressure sensor from the pressure detection device 86.

In step S105, whether the pressure detection value is greater than or equal to a preset pressure threshold value and whether the motor stops driving the drive rod forward are determined.

The controller 81 compares the acquired pressure detection value with the preset pressure threshold value to determine whether the current detection value is greater than or equal to the preset current threshold value. In condition that the pressure detection value is greater than or equal to the preset current threshold value, the electric glue gun 100 is determined to have the load working event; in condition that the pressure detection value is not greater than or equal to the preset current threshold value, the electric glue gun 100 is determined not to have the load working event.

At the same time, whether the motor 11 stops driving the drive rod forward is determined. In an alternative example, a trigger state is monitored in real time by the trigger state detection device, and the controller 81 detects the trigger state by the trigger state detection device; In an alternative example, in condition that the motor 11 exits the operating state of driving the drive rod forward and enters the braking state, or that the motor 11 exits the operating state of driving the drive rod forward and naturally stops, the controller determines that the motor 11 stops driving the drive rod forward.

In response to determining that the load working event has occurred in the electric glue gun 100 and the motor 11 is in the state of stopping driving the drive rod forward, the process goes to step S106, otherwise, the process goes to step S104.

In step S106, the load working duration of the electric glue gun 100 is acquired.

The load working duration determining portion 87 determines the load working duration according to a pressure change detected by the pressure detection device 86.

In an example, the load working duration determining portion 87 may specifically include a comparator and a timer or a counter. The load working duration determining portion 87 acquires the pressure detection value of the pressure detection device 86, and the comparator of the load working duration determining portion 87 compares the pressure detection value with the preset pressure threshold value. In response to determining that the pressure detection value is greater than or equal to the preset pressure threshold value, the timer or counter of the load working duration determining portion 87 starts timing, and does not stop timing or counting until the motor stops driving, and the result of the timer or counter is sent to the controller 81 as the load working duration.

In step S107, the preset duration of reversal of the motor is determined.

The controller 81 determines the preset duration of reversal of the motor by a formula or table lookup according to the load working duration determined by the load working duration determining portion 87, so that the motor 11 is controlled to reverse for the preset duration to enable the drive rod 142 to return by the preset distance. The controller 81 may determine the preset duration of reversal of the motor 11 by a formula or table lookup. The preset duration is positively correlated with the load working duration, that is, the longer the load working duration, the longer the preset duration of reversal of the motor. In this way, the reversal duration of the motor 11 is dynamically adjusted so that the returned distance of the drive rod 142 is positively correlated with the load working duration of the electric glue gun 100, which can avoid the glue overflow phenomenon existing due to the fact that the drive rod 142 returns insufficiently, or looseness of the drive rod 142 or glue gun and the excessive empty stroke of the drive rod 142 in the next boot due to the fact that the drive rod 142 returns excessively, and thus avoid a waste of time and energy.

In step S108, the motor is controlled to reverse for the preset duration to enable the drive rod to return by the preset distance.

The controller 81 controls the motor 11 to reverse for the determined preset duration of reversal of the motor and then stops the motor from driving the drive rod 142 forward after the determined preset duration of reversal of the motor is reached. In this way, the motor is controlled to enable the drive rod 142 to return by the preset distance.

In step S109, the process ends.

The load detection portion 46 is not limited to the current detection circuit 56 and the pressure detection device 86 in the above examples, and may also detect whether the electric glue gun 100 is working under load according to the weight of the electric glue gun 100 with full load and no load. Other load detection devices capable of distinguishing between different operating conditions of the electric glue gun 100 with no load and with load to enable the electric glue gun 100 to return or not return under different operating conditions are all fall within the scope of the present disclosure.

The load working duration determining portion (57, 87) described above may be a separate module or may be built into the controller (51, 81), and use a comparator and a timer or a counter in the controller (51, 81), and is not limited here.

In an alternative example, the electric glue gun 100 further includes a memory and the memory may be built in the controller (41, 51, 81), or may be a separate memory chip. The memory stores at least a state of the electric glue gun 100 before the powering off, and the state includes the speed mode and the rotation speed of the motor before the electric glue gun 100 is powered off. The speed mode includes the jog mode and the non-jog mode, and the non-jog mode includes the constant-speed mode and the speed-adjustment mode.

Figure 11:
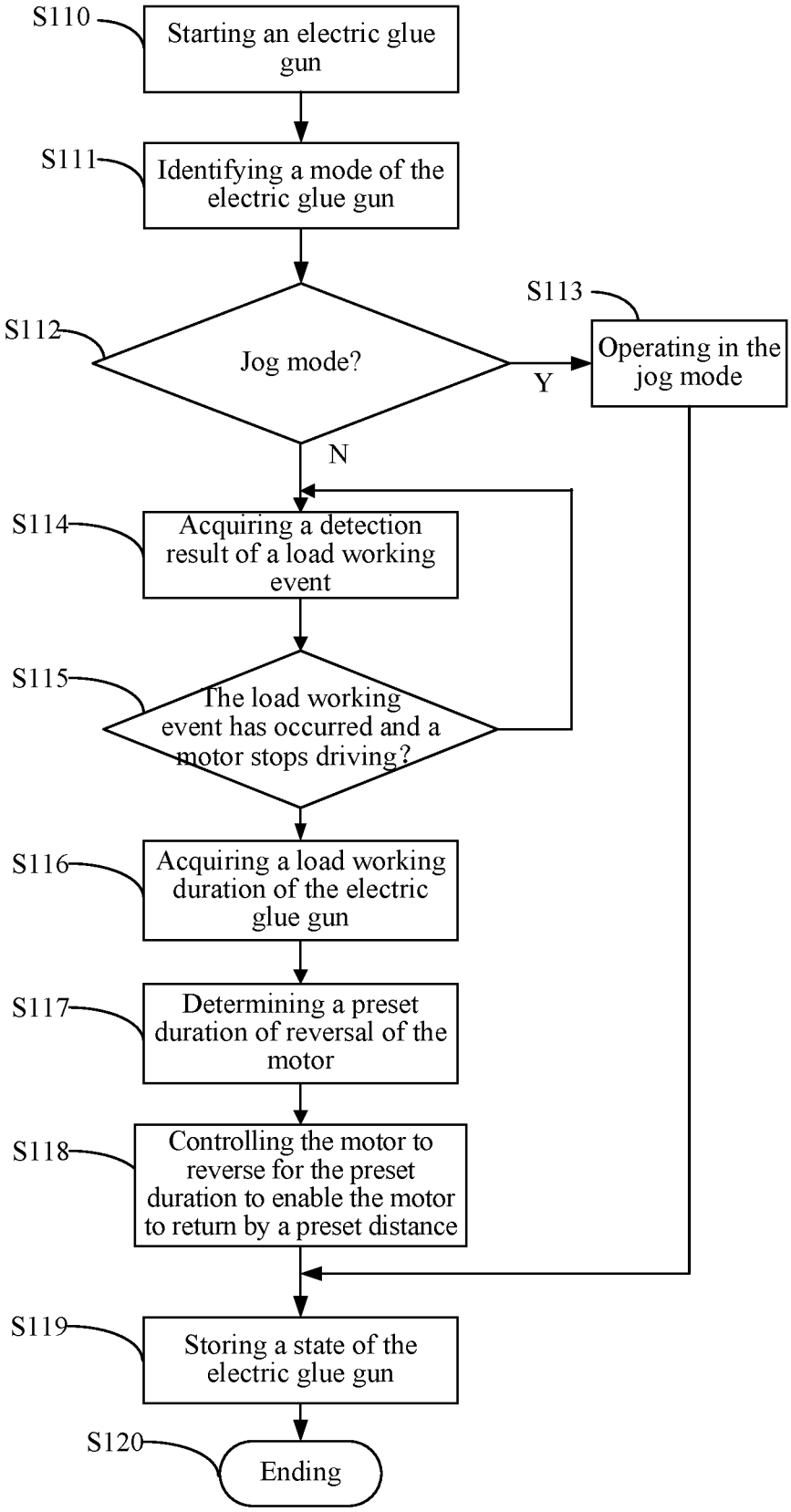
FIG. 11 is a flowchart of a control method for the electric glue gun shown in FIG. 4.

Referring to FIG. 4 and FIG. 11, as a control method for the electric glue gun 100 according to a fifth example, the speed mode and the rotation speed of the motor before the electric glue gun 100 is powered off are stored before the powering off, and the speed mode includes the speed-adjustment mode and the constant-speed mode. The control method for the electric glue gun 100 according to the fifth example is described below.

In step S110, the electric glue gun is started.

The battery pack 10 is mounted to the electric glue gun 100, the trigger is pressed to start the electric glue gun 100, and the controller 41 is powered on.

In step S111, the mode of the electric glue gun is identified.

As described above, the mode of the electric glue gun 100 is detected by the mode detection portion 45, and the controller 41 identifies the mode of the electric glue gun according to the result of the mode detection portion 45.

In step S112, it is determined whether the electric glue gun 100 is in the jog mode.

The controller 41 determines whether the electric glue gun 100 is in the jog mode, and if the electric glue gun 100 is in the jog mode, the process goes to step S113, and the electric glue gun 100 operates in the jog mode until the end, and if the electric glue gun 100 is not in the jog mode, the process goes to step S114.

In step S113, the electric glue gun 100 operates in the jog mode.

In response to determining that the electric glue gun 100 is in the jog mode, operation is continued in an original mode until the end, and the motor is not controlled to enable the drive rod to return by the preset distance.

In step S114, a detection result of the load working event is acquired.

The load detection portion 46 detects the load working event, and the load detection portion 46 may be the current detection circuit 56 or the pressure detection device 86. The current flowing to the motor is detected or the pressure in the glue cartridge 15 is detected to detect whether the electric glue gun 100 works under load or whether the load working event occurs.

In step S115, whether the load working event has occurred and whether the motor is in the state of stopping driving the drive rod forward are determined.

The controller 41 determines whether the electric glue gun 100 works under load or whether the load working event occurs according to the detection result of the load detection portion 46.

At the same time, whether the motor 11 stops driving the drive rod forward is determined. In an alternative example, a trigger state is monitored in real time by the trigger state detection device, and the controller 41 detects the trigger state by the trigger state detection device. In an alternative example, in condition that the motor 11 exits the operating state of driving the drive rod forward and enters the braking state, or that the motor 11 exits the operating state of driving the drive rod forward and naturally stops, the controller determines that the motor 11 stops driving. In condition that the electric glue gun 100 is determined to have the load working event and the motor 11 is in the state of stopping driving the drive rod forward, the process goes to step S116, otherwise, the step goes to step S114.

In step S116, the load working duration of the electric glue gun 100 is acquired.

The load working duration determining portion 47 determines the load working duration of the electric glue gun 100 according to a change in a parameter detected by the load detection portion 46. For the current detection circuit 56, the load working duration determining portion 47 determines the load working duration according to the detected current change; for the pressure detection device 86, the load working duration determining portion 47 determines the load working duration according to the detected pressure change in the glue cartridge 15.

In some alternative examples, the load working duration determining portion 47 may specifically include a comparator and a timer or counter.

In step S117, the preset duration of reversal of the motor is determined.

The controller 41 determines the preset duration of reversal of the motor by a formula or table lookup according to the acquired load working duration. The preset duration is positively correlated with the load working duration, that is, the longer the load working duration, the longer the preset duration of reversal of the motor. In this way, the reversal duration of the motor 11 is dynamically adjusted so that the returned distance of the drive rod 142 is positively correlated with the load working duration of the electric glue gun 100, which can avoid the glue overflow phenomenon existing due to the fact that the drive rod 142 returns insufficiently, or looseness of the drive rod 142 or glue gun and the excessive empty stroke of the drive rod 142 in the next boot due to the fact that the drive rod 142 returns excessively, and thus avoid a waste of time and energy.

In step S118, the motor is controlled to reverse for the preset duration to enable the motor to return by the preset distance.

The controller 41 controls the motor 11 to reverse according to the determined preset duration of reversal of the motor and stops the motor from driving the drive rod forward after the determined preset duration of reversal of the motor is reached. In this way, the motor is controlled to enable the drive rod 142 to return by the preset distance.

In step S119, the state of the electric glue gun is stored.

Before the electric glue gun 100 is powered off, the state of the electric glue gun 100 is stored, the state includes the speed mode and the rotation speed, and the speed mode includes the jog mode, the speed-adjustment mode, and the constant-speed mode.

In step S120, the process ends.

In the initial stage of starting the electric glue gun 100, the state of the electric glue gun before the powering off is read from the memory, the electric glue gun 100 is controlled to operate according to the state before the powering off, and then the operation process of the electric glue gun 100 is controlled according to the control methods of the above examples. The memory described above is provided, so that the state of the electric glue gun before the powering off can be recorded, and thus when the electric glue gun 100 tool is restarted after the powering off, the electric glue gun 100 can still operate in the state before the powering off. For the same batch of working objects, the motor 11 operates at the same better rotation speed after the speed adjustment and the electric glue gun 100 can work with the same better output power, which can ensure a more consistent and better working effect, and can also avoid the trouble of the speed adjustment after the electric glue gun 100 is powered off.

The present disclosure further provides an electric glue gun. The electric glue gun includes: a housing; a motor, which is supported by the housing; a bracket, which extends from the housing and is used for supporting a glue cartridge; a pushing mechanism, which is supported by the housing, connected to the motor, and driven by the motor to squeeze the glue out of the glue cartridge, where the pushing mechanism includes a drive rod and the drive rod is movable in a first direction and a second direction; an operation switch, which is supported by the housing and is movable in at least one direction, where the operation switch can be operated and at least includes an operation state in which the motor is caused to stop driving the drive rod forward; a detection portion, which is configured to operatively detect a load working event of the electric glue gun; and a controller, which is connected to the motor and the operation switch, where the controller is configured to determine whether the electric glue gun is in a first stop mode or a second stop mode according to a detection result of the detection portion and an operation state of the operation switch; in response to determining that the electric glue gun is in the first stop mode, the motor is controlled to enable the drive rod to return by a preset distance; in response to determining that the electric glue gun is in the second stop mode, the motor is controlled not to enable the drive rod to return.

Further, in condition that the detection portion detects the load working event and the operation switch is in the operation state in which the motor is caused to stop driving the drive rod forward, the controller determines that the electric glue gun is in the first stop mode; in condition that the detection portion does not detect the load working event and the operation switch is in the operation state in which the motor is caused to stop driving the drive rod forward, the controller determines that the electric glue gun is in the second stop mode. The detection portion is implemented according to the detection portions of the examples above.

It should be noted that in the present disclosure, the electric glue gun 100 may not include the operation switch located in the electric glue gun 100, that is, a signal for stopping the motor from driving forward is not limited to the input from an external user, but may also be an electrical signal from inside the electric glue gun 100, for example, the glue spraying work needs to be stopped after the controller detects a parameter having a change or reaching a critical value. For example, in condition that the electric glue gun 100 detects that the battery pack is at too high a temperature or is under voltage, etc., the controller 41 stops outputting the signal that causes the motor to operate, and the motor stops driving the drive rod forward.

In summary, the above electric glue gun 100 has at least the following beneficial effects.

When the electric glue gun detects that the trigger is released, the motor is controlled to reverse for the preset duration to enable the drive rod return by a certain distance, so that the glue is prevented from continuing to flow out or seep out of the nozzle of the glue gun after the trigger is released and the glue growing stops, and thus a glue waste and nozzle dirt are avoided. The electric glue gun of the present disclosure can effectively avoid glue overflow after the trigger is released.

It is detected whether the load working event has occurred (that is, whether the glue spraying work has been performed) in the electric glue gun, and thus the drive rod only returns by a certain distance in condition that the load working event is detected so that the glue does not overflow, and in condition that the glue spraying work is not detected, the drive rod does not return, reducing unnecessary operations, simplifying operations, and also saving energy.

The returned distance of the drive rod is adjusted according to the glue growing duration, so that the returned distance of the drive rod is positively correlated with the glue spraying duration, which can avoid that the drive rod 142 returns by a fixed distance as the durations of glue spraying are different, which may thus avoid glue dripping due to the fact that the drive rod 142 returns insufficiently, or looseness of the electric glue gun and the excessive empty stroke of the drive rod in the next boot due to the fact that the drive rod 142 returns excessively, and then avoid a waste of time and energy.

The speed governor is provided to achieve different power outputs of the electric glue gun to meet the needs of different working conditions; at the same time, a control mechanism with an output power upper limit is provided and may be provided with a plurality of gears, which can achieve speed adjustment of the electric glue gun in a plurality of gears, and the upper limit of the output power is set for each gear. The motor has different highest rotation speeds in the plurality of gears, which can avoid unexpected excessive output power and motor rotation speed due to excessive hooking magnitude of the trigger by the user, and it is convenient for the user to operate and have good safety; at the same time, the plurality of gears corresponds to different speed adjustment ranges, so that the user can choose different speed adjustment ranges according to different needs for easy operation.

The speed-adjustment mode, the constant-speed mode, and the jog mode are provided to meet different needs of the user. In the speed-adjustment mode, the rotation speed of the motor is determined according to the hooking magnitude of the trigger, which is convenient for the user to use. In the constant-speed mode, the motor can maintain a fixed speed in a gear, which can prevent the user from difficulty and inconvenience caused by pressing and holding the trigger all the time, and avoid the possibility of speed instability caused by hand trembling of the user, so that the glue is prevented from being non-uniform and the quality of work is prevented from being affected; in the jog mode, the motor outputs the rotation speed every preset duration, and the electric glue gun grows glue every preset duration, which can prevent the glue from always being discharged and reduce unnecessary waste.

The memory with a power-off storage function is provided, so that the state of the electric glue gun before the powering off can be recorded, and thus when the electric glue gun tool is restarted after the powering off, the electric glue gun can still operate in the state before the powering off. For the same batch of working objects, the motor can operate at the same rotation speed, which can ensure a more consistent and better working effect of the electric glue gun, and can also avoid the trouble of the speed adjustment after the electric glue gun is powered off.

However, the existing electric glue gun still has some defects. After the user releases the trigger to stop the glue spraying work: the glue sheet used for holding the glue is wrinkled due to being squeezed, the glue may be stuck on the jacking head 142*a* of the drive rod 142, and the user needs a force to pull the glue sheet out for replacement.

In addition, some existing electric glue guns have the locking mechanism 144 (FIG. 3). The locking mechanism 144 is used for preventing the drive rod 142 from moving forward when the drive rod 142 reaches a limited position, so as to prevent the glue from leaking out of the nozzle and polluting the nozzle due to the drive rod 142 being too close to the front; and in condition that the drive rod 142 exceeds the limited position, the locking structure will be stuck, which is inconvenient for the unlocking operation. In condition that the locking mechanism 144 does not exceed the limited position, the locking mechanism can be conveniently and operatively unlocked to enable the drive rod 142 to move forward.

Figure 12:
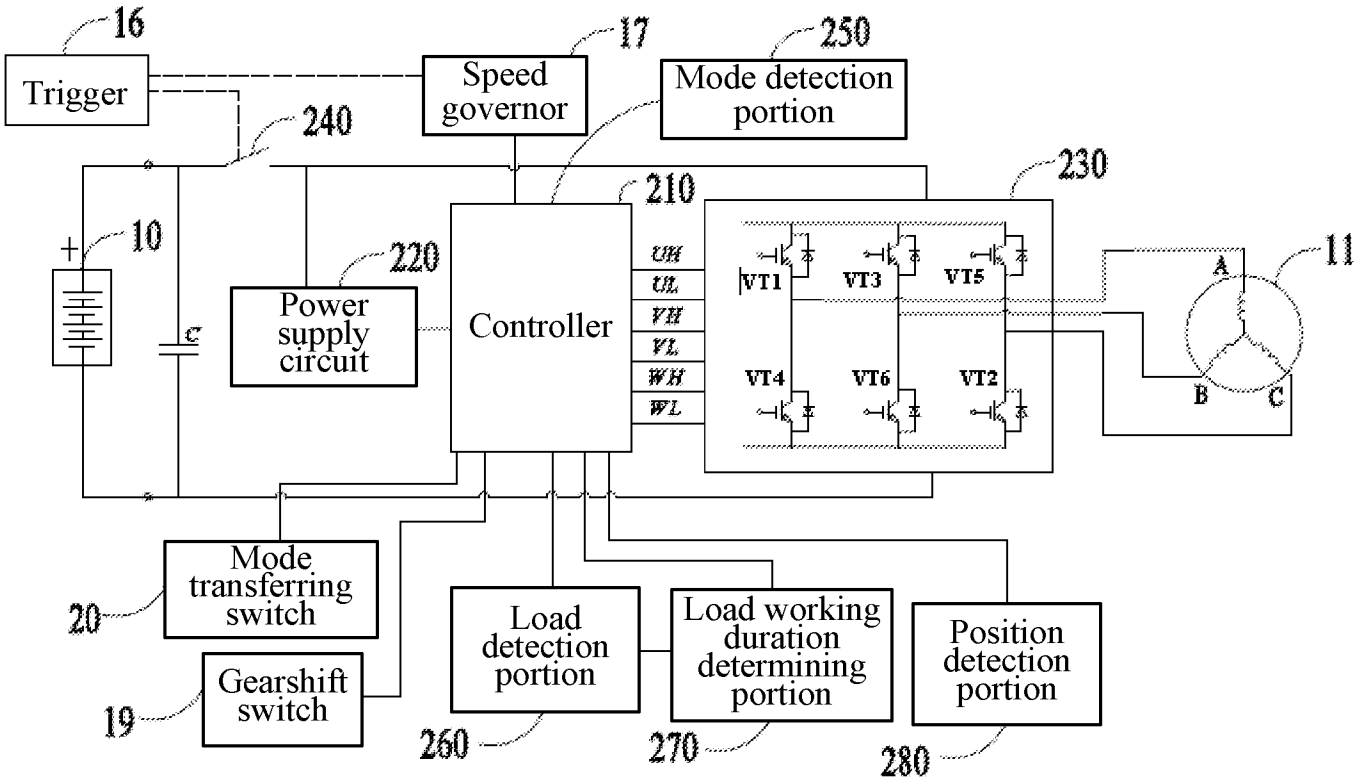
FIG. 12 is a schematic circuit diagram of an electric glue gun according to a fourth example.

Referring to FIG. 12, in order to solve the problems above, the present disclosure further provides an electric glue gun including a controller 210, a power supply circuit 220, and a driving circuit 230. The controller 210 is configured to control the motor 11 to enable the drive rod 142 to return by a preset distance after the drive rod 142 reaches the limited position.

In order to achieve the objects above, the electric glue gun 200 further includes a position detection portion 280 used for detecting whether the drive rod 142 has reached the limited position; the controller 210 is configured to control the motor 11 to enable the drive rod 142 to return by a preset distance after the drive rod 142 reaches the limited position. In this example, the limited position is the maximum stroke position that can be reached by the drive rod 142, and may be defined by providing a structure, or may also be fed back to the controller through electric signals from electronic components and the like to prevent the drive rod from continuing to move forward. In an alternative example, at the maximum stroke position reached by the drive rod 142, the drive rod 142 is locked by the locking mechanism 144.

The position detection portion 280 is configured to output a signal to the controller after detecting that the drive rod reaches the limited position, and the signal is used for causing the controller to control the motor to enable the drive rod to return by the preset distance. The signal may be an electric signal, such as a signal outputted by a sensor, or a mechanical signal, such as a triggering action of a mechanical structure.

The position detection portion 280 may perform detection in an electronic manner and output an electric signal to the controller 210 when the drive rod reaches the limited position, so as to cause the motor 11 to reverse to enable the drive rod 142 to return by the preset distance, or may trigger an action in a mechanical manner when the drive rod 142 reaches the limited position, so as to cause the motor 11 to reverse to drive the drive rod 142 to return by the preset distance.

In some specific examples, the position detection portion 280 includes a magnetic sensor 281 and a magnetic element 282. The magnetic sensor 281 may be, but is not limited to, a Hall sensor. One of the magnetic sensor 281 and the magnetic element 282 is directly or indirectly disposed on the housing 12 and is fixed disposed relative to the housing 12, and the other of the magnetic sensor 281 and the magnetic element 282 is disposed on the drive rod 142 and is movable with the drive rod 142. In a specific solution, the magnetic sensor 281 is configured to be fixedly disposed relative to housing 12, and the magnetic element is disposed on the drive rod 142. When the drive rod 142 reaches the limited position, the magnetic sensor 281 can sense the magnetic field of the magnetic element 282 and output a signal to the controller 210. After the controller 210 obtains the signal, the motor 11 is controlled to reverse to enable the drive rod 142 to return by the preset distance.

In some specific examples, the position detection portion 280 may further include a proximity switch, a limit switch, a photoelectric sensor, and the like, as long as the fact that the drive rod 142 has reached the limited position can be detected, a mechanical or an electric signal can be outputted after the limited position is reached, and the mechanical signal or the electric signal is fed back to the controller 210 or a control circuit (for example, a motor commutation circuit) so as to reverse the motor 11. The mechanical signal or the electric signal is used for causing the motor to reverse to drive the drive rod 121 to return by the preset distance. The mechanical signal may also be fed back to the control circuit (for example, a motor commutation circuit) after being converted from the mechanical signal to the electric signal.

In an alternative example, the preset distance by which the drive rod returns is correlated with the rotation speed of the motor.

In an alternative example, the electric glue gun has a plurality of gears, the motor 11 has different highest rotation speeds in the plurality of gears, and the preset distances by which the drive rod 142 returns in different gears are different.

In an alternative example, the higher the gear of the electric glue gun, the higher the highest rotation speed of the motor 11, and then the higher the gear, the greater the preset distance by which the drive rod 142 returns.

Figure 13:
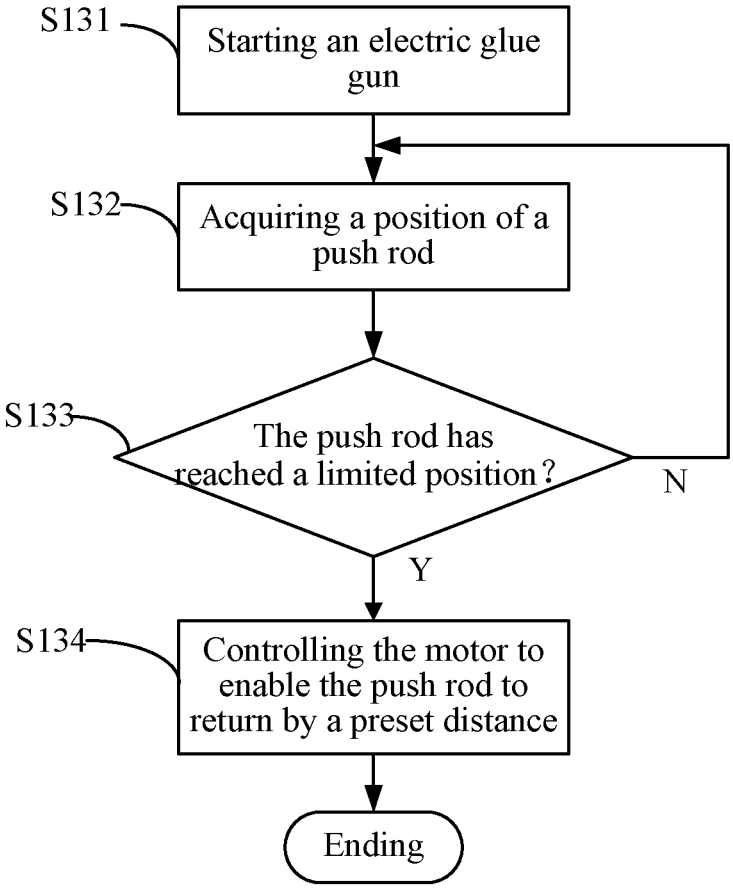
FIG. 13 is a flowchart of a control method for the electric glue gun shown in FIG. 12 according to an example.

The present disclosure further provides a control method for the electric glue gun. Referring to FIG. 13, the control method for the motor according to an example is performed according to the steps below.

In step S131, the electric glue gun is started.

The battery pack 10 is mounted to the electric glue gun, the trigger 16 is pressed to start the electric glue gun, and the controller 210 is powered on.

In step S132, the position of a drive rod is acquired.

The position detection portion 280 detects the position of the drive rod 142 in real time, and outputs a signal to the controller 210 when the position of the drive rod 142 is detected, so that the controller 210 can acquire the position of the drive rod 142.

In step S133, whether the drive rod has reached a limited position is determined.

The controller 210 determines whether the drive rod 142 has reached the limited position according to the signal of the position detection portion 280.

In an example, the position detection portion includes a magnetic sensor 281 and a magnetic element 282. After the controller 210 receives the magnetic sensor 281, the drive rod 142 is determined to reach the limited position.

In step S134, the motor is controlled to enable the drive rod to return by a preset distance.

After the controller 210 determines that the drive rod 142 has reached the limited position, a control signal is outputted to the motor to control the motor 11 to reverse to drive the drive rod 142 to return by the preset distance.

In other examples, the signal of the position detection portion 280 is fed back to a control circuit (for example, a motor commutation circuit). After receiving the signal, the control circuit controls the motor 11 to reverse to drive the drive rod 142 to return by the preset distance.

In step S135, the process ends.

In an alternative example, the electric glue gun 200 further includes: a current switch 240, a mode detection portion 250, a load detection portion 260, a load working duration determining portion 270, the motor 11, the trigger 16, the speed governor 17, the gearshift switch 19, the mode transferring switch 20, and the memory (not shown). The above circuit components are the same as or similar to those in the foregoing examples, and details are not repeated here.

Figure 14:
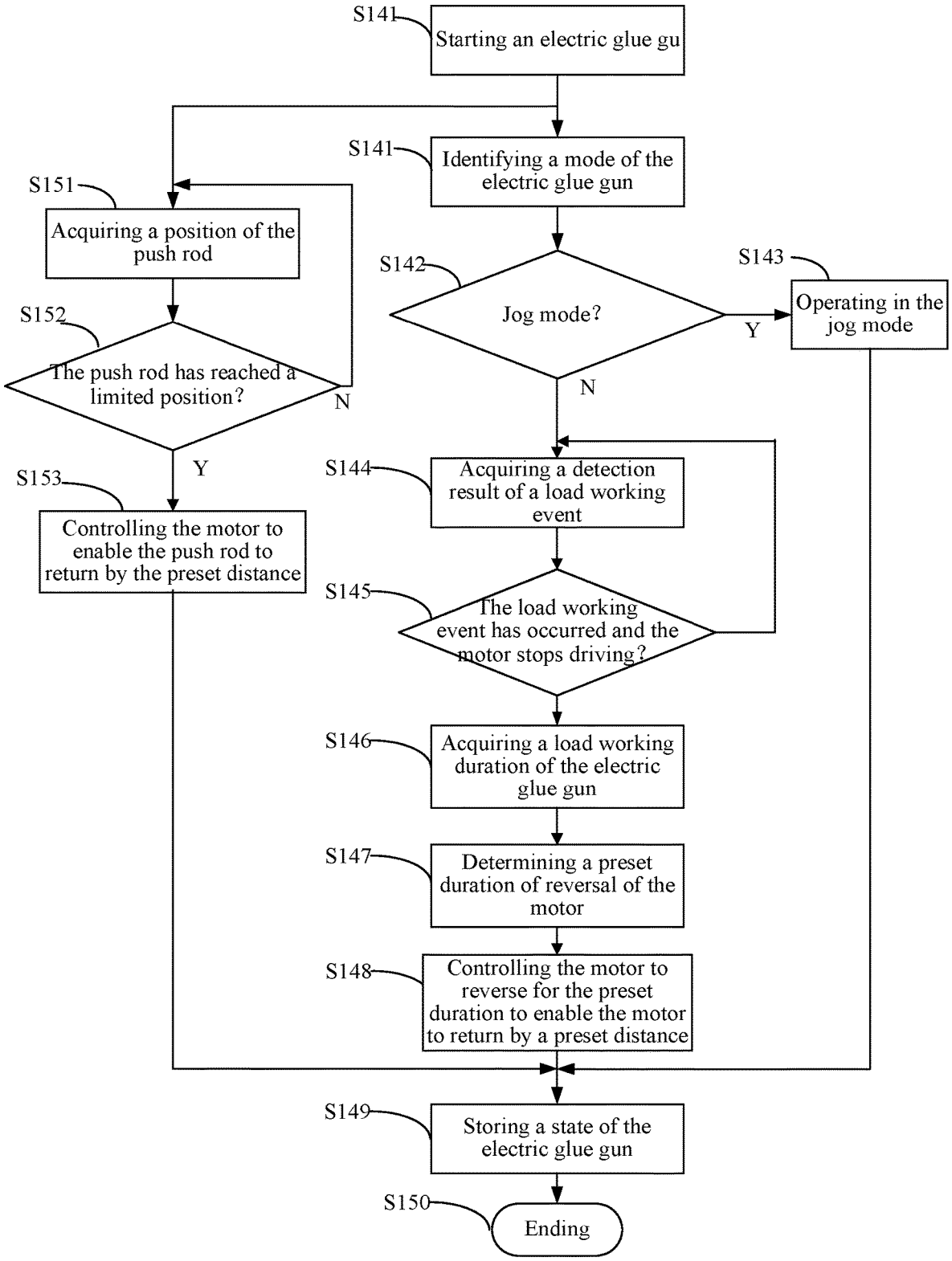
FIG. 14 is a flowchart of a control method for the electric glue gun shown in FIG. 12 according to another example.

Referring to FIG. 14, a control method for a motor according to an example is performed according to the steps below.

In step S140, the electric glue gun is started.

The battery pack 10 is mounted to the electric glue gun 100, the trigger 16 is pressed to start the electric glue gun 100, and the controller 210 is powered on.

In step S141, the mode of the electric glue gun is identified.

As described above, the mode of the electric glue gun 100 is detected by the mode detection portion 250, and the controller 210 identifies the mode of the electric glue gun according to the result of the mode detection portion 250.

In step S142, it is determined whether the electric glue gun 100 is in the jog mode.

The controller 210 determines whether the electric glue gun 100 is in the jog mode, if the electric glue gun 100 is in the jog mode, the process goes to step S143, and the electric glue gun 100 operates in the jog mode until the end, and if the electric glue gun 100 is not in the jog mode, the process goes to step S144.

In step S143, the electric glue gun 100 operates in the jog mode.

In response to determining that the electric glue gun 100 is in the jog mode, operation is continued to operate in an original mode until the end, and the motor is not controlled to enable the drive rod to return by the preset distance.

In step S144, a detection result of the load working event is acquired.

The load detection portion 260 detects the load working event, and the load detection portion 260 may be the current detection circuit 56 or the pressure detection device 86, and detects the current flowing to the motor 11 or the pressure in the glue cartridge 15 to detect whether the electric glue gun 100 works under load or whether the load working event occurs.

In step S145, whether the load working event has occurred and whether the motor is in the state of stopping driving the drive rod forward are determined.

The controller 210 determines whether the electric glue gun 100 works under load or whether the load working event occurs according to the detection result of the load detection portion 260.

At the same time, whether the motor 11 stops driving the drive rod forward is determined. In an alternative example, a trigger state is monitored in real time by the trigger state detection device, and the controller 210 detects the trigger state by the trigger state detection device; In an alternative example, in condition that the motor 11 exits the normal operating state and enters the braking state, or that the motor 11 exits the normal operating state and naturally stops, the controller determines that the motor 11 stops driving the drive rod forward.

In response to determining that the electric glue gun has the load working event and the motor 11 is in the state of stopping driving the drive rod forward, the process goes to step S146, otherwise, the process goes to step S144.

In step S146, the load working duration of the electric glue gun 100 is acquired.

The load working duration determining portion 270 determines the load working duration of the electric glue gun 100 according to a change in a parameter detected by the load detection portion 260. If the load detection portion 260 adopts the current detection circuit 56, the load working duration determining portion 270 determines the load working duration according to the detected current change; if the load detection portion 260 adopts the pressure detection device 86, the load working duration determining portion 270 determines the load working duration according to the detected pressure change in the glue cartridge 15.

In some specific examples, the load working duration determining portion 270 may specifically include a comparator and a timer or counter.

In step S147, the preset duration of reversal of the motor is determined.

The controller 210 determines the preset duration of reversal of the motor by a formula or table lookup according to the acquired load working duration. The preset duration is positively correlated with the load working duration, that is, the longer the load working duration, the longer the preset duration of reversal of the motor. In this way, the reversal duration of the motor 11 is dynamically adjusted so that the returned distance of the drive rod 142 is positively correlated with the load working duration of the electric glue gun 100, which can avoid the glue overflow phenomenon existing due to the fact that the drive rod 142 returns insufficiently, or looseness of the drive rod 142 of glue gun and the excessive empty stroke of the drive rod 142 in the next boot due to the fact that the drive rod 142 returns excessively, and thus avoid a waste of time and energy.

In step S148, the motor is controlled to reverse for the preset duration to enable the motor to return by the preset distance.

The controller 210 controls the motor 11 to reverse according to the determined preset duration of reversal of the motor and stops the motor from rotating after the determined preset duration of reversal of the motor is reached, so as to enable the drive rod 142 to return by the preset distance. In this way, the motor is controlled to enable the drive rod 142 to return by the preset distance.

In step S149, the state of the electric glue gun is stored.

Before the electric glue gun 100 is powered off, the state of the electric glue gun 100 is stored, the state includes the speed mode and the rotation speed, and the speed mode includes the jog mode, the speed-adjustment mode, and the constant-speed mode. After the step S149 is performed, the process goes to step S150.

In the initial stage of starting the electric glue gun, the state of the electric glue gun before the powering off is read from the memory, the electric glue gun is controlled to operate according to the state before the powering off. The memory is provided, so that the state of the electric glue gun before the powering off can be recorded, and thus when the electric glue gun is restarted after the powering off, the electric glue gun can still operate in the state before the powering off. For the same batch of working objects, the motor 11 operates at the same better rotation speed after the speed adjustment and the electric glue gun can work with the same output power, which can ensure a more consistent and better working effect, and can also avoid the trouble of the speed adjustment after the electric glue gun is powered off.

In step S150, the process ends.

The electric glue gun is powered off and stops.

In step S151, the position of a drive rod is acquired.

The position detection portion 280 detects the position of the drive rod 142 in real time, and outputs a signal to the controller 210 when the position of the drive rod 142 is detected, so that the controller 210 can acquire the position of the drive rod 142.

In step S152, whether the drive rod has reached a limited position is determined.

The controller 210 determines whether the drive rod 142 has reached the limited position according to the signal of the position detection portion 280.

In an example, the position detection portion includes a magnetic sensor 281 and a magnetic element 282. After the controller 210 receives the magnetic sensor 281, the drive rod 142 is determined to reach the limited position.

In step S153, the motor is controlled to enable the drive rod to return by a preset distance.

After the controller 210 determines that the drive rod 142 has reached the limited position, a control signal is outputted to the motor to control the motor 11 to reverse to drive the drive rod 142 to return by the preset distance.

In other examples, the signal of the position detection portion 280 is fed back to a control circuit (for example, a motor commutation circuit). After receiving the signal, the control circuit controls the motor 11 to reverse to drive the drive rod 142 to return by the preset distance. After the step S153 is performed, the process goes to step S150.

In actual operation, the preset duration of reversal of the motor can be used to correspond to the returned preset distance of the drive rod 142, and the preset duration of reversal of the motor can be prestored in the memory by the user. In an alternative example, the preset duration of reversal of the motor is positively correlated with the rotation speed of the motor. In an alternative example, the preset duration of reversal of the motor is positively correlated with the gear of the gearshift switch, and the higher the gear, the higher the corresponding highest rotation speed of the motor, and the longer the preset duration of reversal of the motor.

The advantages are as follows: firstly, after the motor stops driving the drive rod forward or after the user releases the trigger 16 or after the drive rod reaches the limited position, the motor is controlled to enable the drive rod 142 to return to release the pressure, which can prevent the glue from continuing to overflow and thus prevent unnecessary waste and pollution; secondly, different gears correspond to different speeds of the drive rod 142, and the drive rod 142 need to return by different distance to release different pressures, so as to ensure that the pressures in different gears can be completely released through returning by different distances.

For the electric glue gun adopting a screw rod as the drive rod to squeeze the glue, if the returning action is not adopted after the drive rod 142 reaches the limited position, on the one hand, the jacking head 142*a* on the front end of the drive rod 142 is easily pushed to an end cover of a front end of the glue cartridge, thus causing damage to other associated structures of the electric glue gun; on the other hand, if the drive rod 142 continues to move after reaching the limited position, a rear end opposite the front end of the drive rod 142 will also be stuck by the locking mechanism 144, causing the user to be unable to unlock. At the same time, the electric glue gun is controlled to perform the returning action after the detection of reaching the limited position, so that it is more beneficial for the user to disengage the jacking head 142*a* on the front end of the drive rod 142 from the glue skin to be used up, and it is convenient for the user to replace glue.

However, with the above method, a problem exists when the electric glue gun 100 is used again. The drive rod 142 has to overcome the returned distance in last use before normal glue spraying, especially when operation is performed in a low-speed gear, the user needs to wait for a period of time before the electric glue gun 100 works normally, wasting time.

In order to solve the above problem, on the other hand, the present disclosure provides an electric glue gun and a startup control method for the electric glue gun, which can effectively avoid the occurrence of the above problem.

Figure 15:
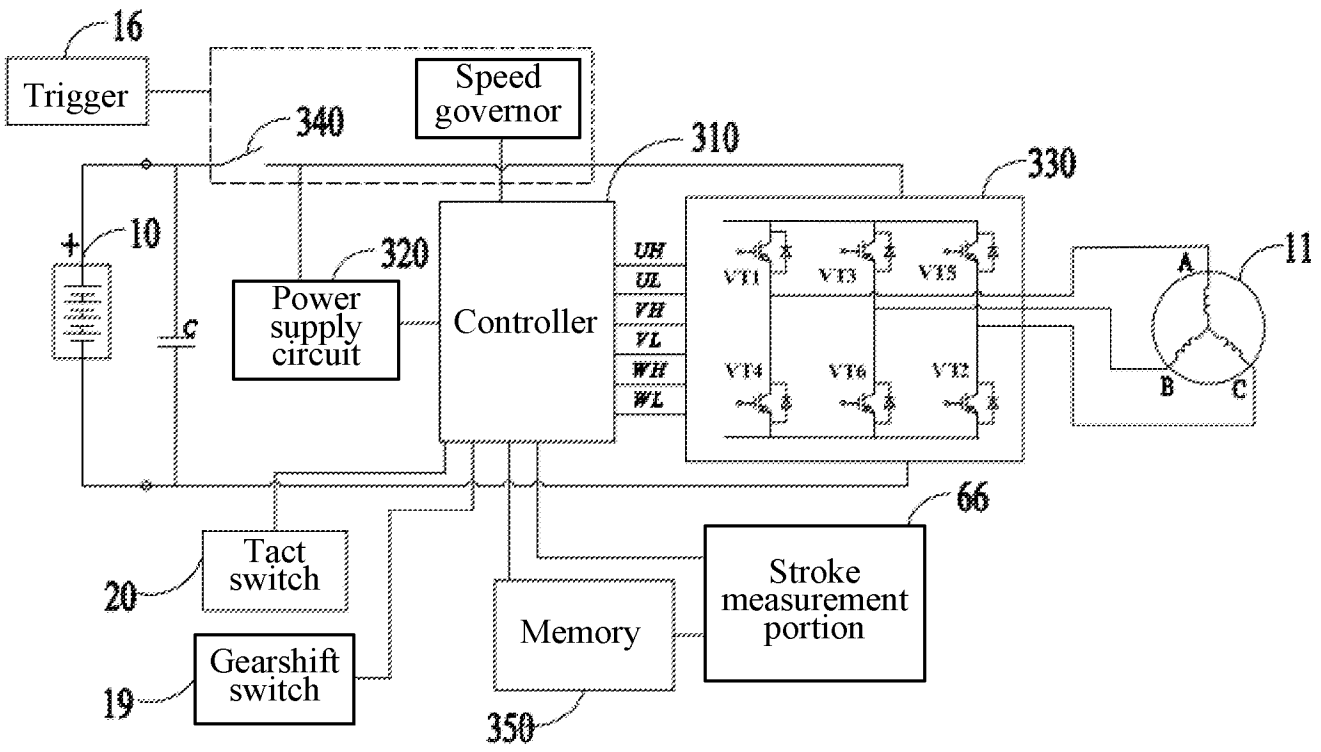
FIG. 15 is a schematic circuit diagram of an electric glue gun according to a fifth example.

Referring to FIG. 15, in this example, a controller 310 is configured to perform the following operations: when the electric glue gun 100 is restarted, the controller 310 accesses the electric energy to control the electric glue gun 100 to enter an acceleration mode, so that the drive rod 142 is accelerated to overcome a returned preset distance of the drive rod after the motor stops driving the drive rod forward; after the drive rod 142 has overcome the returned preset distance, the controller 310 controls the electric glue gun 100 to switch to a speed mode and a rotation speed which are set by the user. Specifically, a current switch 340 is turned on, a power supply circuit 320 is powered, and the controller 310 obtains electric energy from the power supply circuit 320 and controls the motor 11 to work. In other examples, when the trigger 16 is pressed to a first position, the current switch 340 is turned on, and the controller 310 accesses the electric energy to control the motor.

In an alternative example, the electric glue gun 100 includes a memory 350, and data stored in the memory 350 will not be lost after the powering off. The memory 350 may be a separate memory chip, or may be built in the controller 310. The memory 350 stores at least a state of the electric glue gun 100 in last use. The state includes at least a speed mode before the motor stops driving the drive rod forward and the returned preset distance of the drive rod 142. The speed mode includes a speed-adjustment mode, a constant-speed mode and a jog mode. The memory 350 with a power-off storage function is provided, so that the state of the electric glue gun 100 in last use can be recorded, and thus when the electric glue gun 100 is restarted, the drive rod 142 accelerates forward to overcome the returned preset distance of the drive rod 142. It should be understood that, the state of the electric glue gun 100 in last use may also include the rotation speed of the motor of the electric glue gun 100 and the reversal duration of the motor, which is not limited here.

Specifically, after the electric glue gun 100 is powered on, the controller 310 is configured to read the speed mode before the motor of the electric glue gun 100 stops driving the drive rod forward and the returned distance of the drive rod 142 from the memory. If the jog mode is used, the electric glue gun 100 directly enters a speed mode already set by the user to work; if the non-jog mode is used, for example, the constant-speed mode or the speed-adjustment mode is used, the controller 310 controls the electric glue gun 100 to enter a acceleration mode, so that the motor accelerates to push the drive rod 142 forward, and after the drive rod 142 overcomes the returned preset distance, the controller 310 controls the electric glue gun 100 to switch to the speed mode and the rotation speed which are set by the user to work.

In an alternative example, the electric glue gun 100 further includes a stroke measurement portion 66 used for detecting a distance by which the drive rod 142 advances or returns, and the stroke measurement portion 66 is electrically connected to the memory 350. Specifically, the stroke measurement portion 66 may be a displacement sensor disposed at the front end of the drive rod 142, can measure the returned distance of the drive rod 142, and sends a returned distance signal to the memory 350. The memory 350 stores the returned distance in the memory 350. When the electric glue gun is restarted, the controller 310 controls the motor 11 to accelerate to push the drive rod 142 forward, and when the displacement sensor detects that the drive rod 142 has overcome the returned preset distance, a forward distance signal is sent to the controller 310, so that the controller 310 controls the electric glue gun 100 to switch to the speed mode and the rotation speed which are set by the user to work. In an example, the stroke measurement portion 66 may be a revolution counter for detecting the number of revolutions of the motor. Each revolution the motor rotates, the drive rod advances a certain distance, so the number of revolutions of the rotor of the motor can reflect the returned distance of drive rod 142 which will be then stored in the memory 350; when the glue gun is restarted, the controller 310 controls the motor 11 to accelerate to push the drive rod forward, the revolution counter detects the number of revolutions of the rotor of the motor and sends the number to the controller 310. After the controller 310 detects that the motor has overcome the number of revolutions of reversal, that is, after the drive rod 142 overcomes the returned preset distance, the controller 310 controls the electric glue gun 100 to switch to the speed mode and the rotation speed which are set by the user to work.

In an example, the stroke measurement portion 66 may also be a timing unit. The timing unit is used for determining a duration of reversal of the motor, and the timing unit is electrically connected to the memory 350. Specifically, the timing unit records a reversal duration of the electric glue gun 100 and sends the reversal duration to the controller 310. The controller 310 is configured to calculate the returned distance of the drive rod 142 according to the duration of reversal of the motor and the rotation speed of reversal, and when the electric glue gun is restarted, the controller 310 controls the electric glue gun 100 to enter the acceleration mode, so that the motor 11 is accelerated to push the drive rod 142 forward. The controller 310 is also configured to calculate the forward distance of the drive rod 141 according to the present rotation speed and forward duration of the motor, and when the forward distance of the drive rod is equal to the returned distance of the drive rod before the powering off, the controller 310 controls the electric glue gun 100 to switch to the speed mode and the rotation speed which are set by the user to work.

In an alternative example, the electric glue gun 100 is further provided with a load detection portion for detecting a load working event of the electric glue gun 100, and an output terminal of the load detection portion is electrically connected to the controller 310. Specifically, after the electric glue gun 100 is powered on, the controller 310 controls the motor 11 to accelerate to push the drive rod forward. The controller 310 determines whether the load working event occurs in the electric glue gun 100 according to a detection result of the load detection portion. After determining that the load working event occurs in the electric glue gun 100, the controller 310 controls the motor to switch to the speed mode and the rotation speed which are set by the user to work.

In an example, the load detection portion may be a current detection circuit that detects whether the electric glue gun 100 works under load by detecting a current flowing to the motor 11. Specifically, the current detection circuit is electrically connected to a main circuit for detecting a current flowing to a winding of the motor 11. When the drive rod 142 pushes the glue to move, the drive rod 142 will receive the reaction force of the glue, a load of the motor 11 will be larger than the empty load, and the current at this time will be larger than the current when no load is provided, so it can be detected whether the electric glue gun 100 has the load working event through detection of the current flowing to the motor 11. An output terminal of the current detection circuit is electrically connected to the controller 310, and the controller 310 determines whether the load working event occurs in the electric glue gun 100 according to a detection result of the current detection circuit. After the electric glue gun 100 is powered on, the controller 310 controls the motor to accelerate to push the drive rod 142 forward, and after determining that the load working event occurs in the electric glue gun 100, the controller 310 controls the motor to switch to the speed mode and the rotation speed which are set by the user to work.

Specifically, the controller 310 compares the current value detected by the current detection circuit with a preset current threshold value, the preset current threshold value corresponds to an inflection point of a current change, that is, the current when the load occurs. In response to determining that the current detection value is greater than the preset current threshold value, it is determined that the load working event has occurred in the electric glue gun 100, and in response to determining that the current detection value is not greater than the preset current threshold value, it is determined that no load working event has occurred in the electric glue gun 100.

In an example, the load detection portion may be a micro switch, the load detection portion is disposed at the front end of the drive rod 142, and the controller 310 determines whether the load working event occurs in the electric glue gun 100 according to an output signal of the micro switch. It should be understood that the micro switch may also be a pressure sensor.

In the electric glue gun 100, a preset distance is returned after the motor stops driving the drive rod forward, and when restarted, the electric glue gun accelerates forward to overcome the returned preset distance. In this way, unnecessary waste and pollution due to glue overflow after use can be avoided and the waiting time when the electric glue gun is used again can be saved with easy operation.

Figure 16:
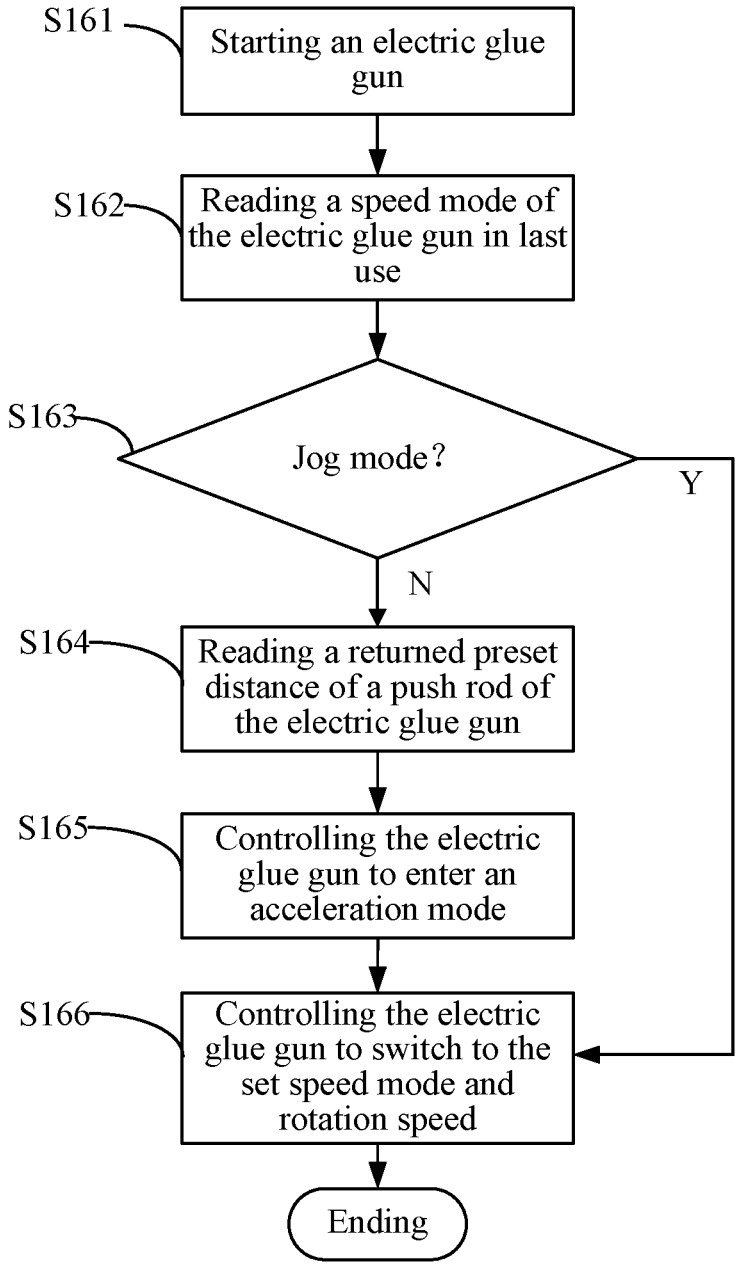
FIG. 16 is a flowchart of a control method for the electric glue gun shown in FIG. 15 according to an example.

Referring to FIG. 16, a control method for starting the electric glue gun 100 according to an example is performed according to the steps below.

In step S161, the electric glue gun is started.

The battery pack 10 is mounted to the electric glue gun 100, the trigger is pressed to start the electric glue gun 100, and the controller 310 is powered on.

In step S162, a speed mode of the electric glue gun in last use is read.

The controller 310 reads the speed mode of the electric glue gun in last use from the memory 350.

In step S163, whether the electric glue gun is in the jog mode before the motor stops driving the drive rod forward is determined.

The controller 310 determines whether the electric glue gun 100 is in the jog mode before the motor stops driving the drive rod forward; if the electric glue gun 100 is in the jog mode before the motor stops driving the drive rod forward, the process goes to step S166, and the electric glue gun works in the set speed mode; if the electric glue gun 100 is not in the jog mode before the motor stops driving the drive rod forward, the process goes to step S164.

In step S164, the returned preset distance of the drive rod of the electric glue gun is read.

In some examples, the controller 310 directly reads the returned distance of the drive rod 142 in the memory 350; in other examples, the controller 310 can calculate the returned distance of the drive rod 142 according to the reversal duration and the reversal rotation speed of the motor 11 of the electric glue gun 100 in the memory 350.

In step S165, the electric glue gun is controlled to enter an acceleration mode.

The controller 310 controls the electric glue gun 100 to enter an acceleration mode according to the determined returned preset distance of the drive rod 142, so that the motor accelerates to push the drive rod 142 forward, and after the drive rod 142 overcomes the returned preset distance, or after the controller 310 determines that the electric glue gun 100 has the load working event, the acceleration mode is exited.

In step S166, the electric glue gun is controlled to switch to a speed mode set by the user.

The controller 310 controls the electric glue gun 100 to enter the speed mode and the rotation speed which are set by the user. The speed mode includes the jog mode, the speed-adjustment mode, and the constant-speed mode.

It should be understood that in the above steps, step S163 can be omitted, and the controller 310 reads the returned distance of the drive rod 142 in last use of the electric glue gun. In condition that the drive rod 142 returns, step S165 is performed; in condition that the drive rod 142 does not return, step S166 is performed.

The basic principles, main features and advantages of the present disclosure have been shown and described above. Those skilled in the art should understand that the above examples do not limit the present disclosure in any form, and that any technical solution obtained by means of equivalent substitution or equivalent transformation falls within the protection scope of the present disclosure.

What is claimed is:

1. An electric glue gun, comprising:

a housing;

a motor, which is supported by the housing;

a bracket, which extends from the housing and supports a glue cartridge;

a pushing mechanism, which is supported by the housing and connected to the motor, wherein the pushing mechanism comprises a drive rod, and the pushing mechanism is driven by the motor to enable the drive rod to squeeze glue out of the glue cartridge;

a controller for controlling the motor wherein the controller controls the motor to enable the drive rod to return by a preset distance after the motor stops driving the drive rod forward or after the drive rod reaches a limited position, and a plurality of gears, wherein the motor has different highest rotation speeds in the plurality of gears, and the preset distances by which the drive rod returns under the different gears are different.

2. The electric glue gun of claim 1, wherein modes of the electric glue gun comprise a jog mode and a non-jog mode, the electric glue gun further comprises a mode detector that detects whether the electric glue gun is in the jog mode or the non-jog mode; and the mode detector is electrically connected to the controller.

3. The electric glue gun of claim 2, wherein the mode detector comprises a timing unit for determining a normal operating duration of the motor and the controller determines that the electric glue gun is in the non-jog mode when the normal operating duration of the motor is greater than or equal to a preset duration.

4. The electric glue gun of claim 3, wherein the controller, after determining that the electric glue gun is in the non-jog mode and after the motor stops driving the drive rod forward, controls the motor to enable the drive rod to return by the preset distance.

5. The electric glue gun of claim 1, comprising a position detector for detecting whether the drive rod has reached the limited position, the position detector outputs a signal to the controller after detecting that the drive rod has reached the limited position, and the controller controls the motor to enable the drive rod to return by the preset distance after the drive rod has reached the limited position.

6. The electric glue gun of claim 5, wherein the position detector comprises a magnetic sensor and a magnetic element, one of the magnetic sensor and the magnetic element is fixedly disposed on the housing, and another one of the magnetic sensor and the magnetic element is disposed on the drive rod whereby, in condition that the drive rod has reached the limited position, the magnetic sensor senses a magnetic field of the magnetic element and outputs the signal to the controller.

7. The electric glue gun of claim 3, wherein the normal operating duration of the motor is an operating duration of the motor at a constant speed or an operating duration of the motor from a time at zero speed to a time before braking.

8. The electric glue gun of claim 1, further comprising a locking mechanism for preventing the drive rod from moving forward after the drive rod has reached the limited position wherein the locking mechanism is operatively unlocked to enable the drive rod to move forward.

* * * * *